US008853517B1

(12) United States Patent
Dixon

(10) Patent No.: US 8,853,517 B1
(45) Date of Patent: Oct. 7, 2014

(54) MUSICAL INSTRUMENT PICKUP INCORPORATING ENGINEERED FERROMAGNETIC MATERIALS

(71) Applicant: George J. Dixon, Socorro, NM (US)

(72) Inventor: George J. Dixon, Socorro, NM (US)

( * ) Notice: Subject to any disclaimer, the term of this patent is extended or adjusted under 35 U.S.C. 154(b) by 0 days.

(21) Appl. No.: 13/827,644

(22) Filed: Mar. 14, 2013

Related U.S. Application Data

(63) Continuation-in-part of application No. 12/940,478, filed on Nov. 5, 2010, now Pat. No. 8,415,551.

(51) Int. Cl.
*G10H 3/18* (2006.01)

(52) U.S. Cl.
USPC ..... 84/726; 84/725

(58) Field of Classification Search
USPC ..... 84/725–728
See application file for complete search history.

(56) References Cited

U.S. PATENT DOCUMENTS

| | | | | |
|---|---|---|---|---|
| 2,225,299 | A | 12/1940 | Demuth | |
| 2,235,983 | A | 3/1941 | Demuth | |
| 2,573,254 | A | 10/1951 | Fender | |
| 2,612,072 | A | 9/1952 | De Armond | |
| 2,612,541 | A | 9/1952 | De Armond | |
| 2,683,388 | A | 7/1954 | Keller | |
| 2,817,261 | A | 12/1957 | Fender | |
| 2,892,371 | A | 6/1959 | Butts | |
| 2,896,491 | A | 7/1959 | Lover | |
| 2,909,092 | A | 10/1959 | De Armond | |
| 2,911,871 | A | 11/1959 | Schultz | |
| 2,933,967 | A | 4/1960 | Ruscol | |
| 2,976,755 | A | 3/1961 | Fender | |
| 3,236,930 | A | 2/1966 | Fender | |
| 3,249,677 | A | 5/1966 | Burns | |
| 3,541,219 | A | 11/1970 | Abair | |
| 3,571,483 | A | 3/1971 | Davidson | |
| 3,588,311 | A | 6/1971 | Bartolini | |
| 3,916,751 | A | 11/1975 | Stich | |
| 3,983,777 | A | 10/1976 | Bartolini | |
| 3,983,778 | A | 10/1976 | Bartolini | |
| 4,010,334 | A | 3/1977 | Demeter | |
| 4,184,398 | A * | 1/1980 | Siegelman | 84/725 |
| 4,220,069 | A | 9/1980 | Fender | |
| 4,283,982 | A | 8/1981 | Armstrong | |
| 4,320,681 | A | 3/1982 | Altilio | |
| 4,364,295 | A | 12/1982 | Stich | |
| 4,499,809 | A | 2/1985 | Clevinger | |
| 4,501,185 | A | 2/1985 | Blucher | |
| 4,524,667 | A | 6/1985 | Duncan | |
| 4,580,481 | A | 4/1986 | Schaller et al. | |

(Continued)

OTHER PUBLICATIONS

Hunter, Duncan et al., "The Guitar Pickup Handbook, The Start of Your Sound"(*Backbeat/Hall* Leonard, New York, 2008) (total of 260 pages).

(Continued)

*Primary Examiner* — David S. Warren
(74) *Attorney, Agent, or Firm* — Leydig, Voit & Mayer, Ltd.

(57) ABSTRACT

Magnetic pickups with unique tonal properties that incorporate components that are formed from an engineered ferromagnetic material. Monolithic and composite pickup components with ferromagnetic loss properties that are novel within the context of magnetic pickup design are fabricated from materials that comprise granules of ferromagnetic hysteresis materials or soft ferromagnetic materials and an insulating binder. The tone of a pickup is modified by retrofitting the pickup to include a bound granular material.

36 Claims, 20 Drawing Sheets

(56) References Cited

U.S. PATENT DOCUMENTS

| | | | | |
|---|---|---|---|---|
| 4,581,974 | A | 4/1986 | Fender | |
| 4,581,975 | A | 4/1986 | Fender | |
| 4,624,172 | A | 11/1986 | McDougall | |
| 4,686,881 | A | 8/1987 | Fender | |
| 4,941,388 | A * | 7/1990 | Hoover et al. | 84/726 |
| 5,123,324 | A | 6/1992 | Rose et al. | |
| 5,168,117 | A * | 12/1992 | Anderson | 84/726 |
| 5,221,805 | A | 6/1993 | Lace | |
| 5,233,123 | A * | 8/1993 | Rose et al. | 84/726 |
| 5,290,968 | A * | 3/1994 | Mirigliano et al. | 84/726 |
| 5,292,998 | A * | 3/1994 | Knapp | 84/726 |
| 5,292,999 | A | 3/1994 | Tumura | |
| 5,336,845 | A * | 8/1994 | Lace, Sr. | 84/726 |
| 5,354,949 | A | 10/1994 | Zwaan | |
| 5,378,850 | A * | 1/1995 | Tumura | 84/727 |
| 5,389,731 | A | 2/1995 | Lace | |
| 5,391,831 | A * | 2/1995 | Lace | 84/726 |
| 5,399,802 | A | 3/1995 | Blucher | |
| 5,408,043 | A * | 4/1995 | Lace | 84/726 |
| 5,418,327 | A | 5/1995 | Lace et al. | |
| 5,422,432 | A * | 6/1995 | Lace | 84/726 |
| 5,430,246 | A * | 7/1995 | Lace et al. | 84/726 |
| 5,530,199 | A * | 6/1996 | Blucher | 84/728 |
| 5,610,357 | A * | 3/1997 | Frank-Braun | 84/726 |
| 5,668,520 | A | 9/1997 | Kinman | |
| 5,792,973 | A * | 8/1998 | Riboloff | 84/726 |
| 5,811,710 | A | 9/1998 | Blucher et al. | |
| 5,834,999 | A | 11/1998 | Kinman | |
| 5,894,101 | A * | 4/1999 | Damm | 84/728 |
| 5,932,827 | A | 8/1999 | Osborne et al. | |
| 5,949,014 | A * | 9/1999 | Rashak et al. | 84/725 |
| 6,103,966 | A * | 8/2000 | Kinman | 84/728 |
| 6,111,185 | A | 8/2000 | Lace | |
| 6,291,758 | B1 | 9/2001 | Turner | |
| 6,291,759 | B1 * | 9/2001 | Turner | 84/726 |
| 6,392,137 | B1 | 5/2002 | Isvan | |
| 6,846,981 | B2 * | 1/2005 | Devers | 84/728 |
| 6,998,529 | B2 | 2/2006 | Wnorowski | |
| 7,022,909 | B2 * | 4/2006 | Kinman | 84/726 |
| 7,166,793 | B2 * | 1/2007 | Beller | 84/723 |
| 7,189,916 | B2 * | 3/2007 | Kinman | 84/726 |
| 7,227,076 | B2 * | 6/2007 | Stich | 84/726 |
| 7,285,714 | B2 * | 10/2007 | Juszkiewicz et al. | 84/726 |
| 7,288,713 | B2 | 10/2007 | Krozack et al. | |
| 7,399,918 | B2 * | 7/2008 | Juszkiewicz et al. | 84/742 |
| 7,427,710 | B2 | 9/2008 | Hara | |
| 7,595,444 | B2 * | 9/2009 | Stewart | 84/728 |
| 7,718,886 | B1 * | 5/2010 | Lace | 84/727 |
| 7,989,690 | B1 * | 8/2011 | Lawing | 84/726 |
| 7,994,413 | B2 | 8/2011 | Salo | |
| 8,178,774 | B2 | 5/2012 | Salehi | |
| 8,471,137 | B2 * | 6/2013 | Adair et al. | 84/726 |
| 2001/0027716 | A1 * | 10/2001 | Turner | 84/726 |
| 2002/0020281 | A1 * | 2/2002 | Devers | 84/728 |
| 2002/0069749 | A1 | 6/2002 | Hoover et al. | |
| 2002/0083819 | A1 | 7/2002 | Kinman | |
| 2002/0092413 | A1 * | 7/2002 | Turner | 84/726 |
| 2003/0051596 | A1 | 3/2003 | Gustafsson | |
| 2003/0196538 | A1 * | 10/2003 | Katchanov et al. | 84/297 S |
| 2004/0003709 | A1 * | 1/2004 | Kinman | 84/728 |
| 2004/0139837 | A1 * | 7/2004 | Oskorep | 84/322 |
| 2005/0092159 | A1 * | 5/2005 | Oskorep | 84/322 |
| 2006/0112816 | A1 * | 6/2006 | Kinman | 84/728 |
| 2006/0150806 | A1 * | 7/2006 | Hara | 84/726 |
| 2006/0156911 | A1 | 7/2006 | Stich | |
| 2006/0174753 | A1 * | 8/2006 | Aisenbrey | 84/600 |
| 2006/0254405 | A1 * | 11/2006 | Bergman | 84/297 R |
| 2006/0275631 | A1 * | 12/2006 | Rosenberg | 429/8 |
| 2007/0017355 | A1 | 1/2007 | Lace | |
| 2007/0056435 | A1 | 3/2007 | Juszkiewicz et al. | |
| 2008/0245218 | A1 * | 10/2008 | Stewart | 84/727 |
| 2009/0320670 | A1 * | 12/2009 | Flum et al. | 84/723 |
| 2010/0005954 | A1 | 1/2010 | Higashidate et al. | |
| 2010/0101399 | A1 | 4/2010 | Calvet | |
| 2010/0122623 | A1 * | 5/2010 | Salo | 84/726 |
| 2011/0100200 | A1 * | 5/2011 | Mayes | 84/726 |
| 2012/0210847 | A1 * | 8/2012 | Adair et al. | 84/726 |
| 2012/0210848 | A1 | 8/2012 | Yamanaka | |
| 2013/0239788 | A1 * | 9/2013 | Mills et al. | 84/726 |

OTHER PUBLICATIONS

Milan, Mario, "Pickups, Windings and Magnets and the Guitar Became Electric", (*Centerstream*, Anaheim Hills, 2007) (total of 216 pages).

French, Richard M., "Engineering the Guitar, Theory and Practice", (*Springer*, New York, 2009) (total of 274 pages).

Bozorth, Richard M., "*Ferromagnetism*", (IEEE Press/Wiley, Hoboken, 2003) (Part 1—244 pages).

Bozorth, Richard M., "*Ferromagnetism*", (IEEE Press/Wiley, Hoboken, 2003) (Part 2—248 pages).

Bozorth, Richard M., "*Ferromagnetism*", (IEEE Press/Wiley, Hoboken, 2003) (Part 3—246 pages).

Bozorth, Richard M., "*Ferromagnetism*", (IEEE Press/Wiley, Hoboken, 2003) (Part 4—244 pages).

Campbell, Peter, "Permanent Magnetic Materials and their Application" (*Cambridge University Press*, Cambridge, 1994) (total 218 pages).

Goldman, Alex. *Modern Ferrite Technology*, 2nd Edition, (Springer, New York, 2006), Part 1 (total pp. 218).

Goldman, Alex. *Modern Ferrite Technology*, 2nd Edition, (Springer, New York, 2006), (Second Part of Doc. No. DB) (total pp. 218).

Errede, Professor Steven, Presentation entitled "*Electronic Transducers for Musical Instruments*", Department of Physics, The University of Illinois at Urban-Campaign, AES Talk, UIUC, Nov. 29, 2005 (43 pages).

Lemme, Helmuth E.W., "*The Secrets of Electric Guitar Pickups*", updated Feb. 25, 2009, retrieved from http://buildyourguitar.com/resources/leme/ on May 10, 2009 (9 pages).

Sulzer, Mike, "*Music Electronics Forum*", retrieved from http://music-electronic-forum.com/t13930/ on Sep. 23, 2009 (9 pages total).

Article entitled *Common Magnetic Terminology as Used in Specification and Claims of U.S. Appl. No. 12/940,478* retrieved from Wikipedia at http://en.eikipedia.org/wiki.

Article entitled "*Seymour Duncan ZephyrTM The Next Great Sound of Guitar*", retrieved from http://www.seymourduncan.com/newproducts/zephyr-silver-pickups.php on Oct. 29, 2011 (15 pages total).

Ressler, Phil, "*Zephyr Silver Background*", retrieved from http://www.seymourduncan.com/forum/showthread.php?t=207793 on May 16, 2012 (15 pages).

Constantinides, Steve, "Semi-Hard Magnets", presented at the *Magnetics 2011 Conference* in San Antonio TX on Mar. 1-2, 2011 (27 pages).

Lawrence, Bill, *How Would an Aluminum Bridge Plate Compare with other TeleBridge Plates*?, retrieved from http://www.billarence.com/Page/ForteleLovers.htm on Dec. 2, 2011 (2 pages).

Lawrence, Bill, "*Bridge Pickup Base Plates*", retrieved from http://www.tdpri.com/resourceBASEPLATE.htm on Dec. 6, 2011 (2 pages).

Lemme, Helmuth, "Electric Guitar Sound Secrets and Technology", *Elektor International Media BV* 2012, ISBN 978-907920-13-4, (Part 1—70 pages).

Lemme, Helmuth, "Electric Guitar Sound Secrets and Technology", *Elektor International Media BV* 2012, ISBN 978-907920-13-4, (Part 2—69 pages).

Lemme, Helmuth, "Electric Guitar Sound Secrets and Technology", *Elektor International Media BV* 2012, ISBN 978-907920-13-4, (Part 3—66 pages).

Lemme, Helmuth, "Electric Guitar Sound Secrets and Technology", *Elektor International Media BV* 2012, ISBN 978-907920-13-4, entire book, (279 pages).

Article entitled "Beefing Up Single Coils, This month we will try some new tone tailoring tricks", *PremierGuitar*, from http:www.premierguitar.com/Magzine/Issue/2007.Aug.Befing_Up_Single_Coil.asp x on Nov. 23, 2012 (3 pages).

(56) References Cited

OTHER PUBLICATIONS

Article retrieved from http://www.symourduncan.com.products/bass/pbas/passive/110441_pickup on Dec. 17, 2012, *Antiguity for P-Bass®*: (twin cil) 11044-11-SeymourDuncanPassive (2 pages).
DiMarzio, "*Ultra JazzTM Pair DP149*", retrieved from http://www.dimarzio.com/pickups/bass/standard-bass/ultra-jazz-pair on Nov. 29, 2012 (2 pages).
Constantinides, Steve, Presentation entitled "*Undercover Magnets*", Iowa State University—MRS, Apr. 7, 2011 (44 pages).
Strnat, Karl J., "Modern Permanent Magnets for Application in Electro-Technology", *Proc. IEE*, vol. 78, pp. 923 (1990) (35 pages).
Constantinides, Steve, Presentation entitled "Designing with Thin Gauge", *SMMA Fall Technical Conference*, Oct. 2008, (55 pages).
Cullity, B.D., et al., "Introduction to Magnetic Materials", *IEEE* Press/Wiley, Hoboken (2008).(Part 1—145 pages).
Cullity, B.D., et al., "Introduction to Magnetic Materials", *IEEE* Press/Wiley, Hoboken (2008).(Part 2—140 pages).
Cullity, B.D., et al., "Introduction to Magnetic Materials", *IEEE* Press/Wiley, Hoboken (2008).(Part 3—132 pages).
Cullity, B.D., et al., "Introduction to Magnetic Materials", *IEEE* Press/Wiley, Hoboken (2008).(Part 4—44 pages).
Lemarquand, G., et al., "Calculation Method of Permanent-Magnet Pickups for Electric Guitars", *IEEE Transactions on Magnetics*, vol. 43., No. 9, (Sep. 2007, pp. 3573-3578).
Horton, Nicholas G., et al., "Modeling the Magnetic Pickup of an Electric Guitar", *American Journal of Physics*, vol. 77., No. 2, (Feb. 2009, pp. 144-150).

* cited by examiner

MUSICAL INSTRUMENT PICKUP INCORPORATING ENGINEERED FERROMAGNETIC MATERIALS

CROSS-REFERENCE TO RELATED APPLICATION

This application is a continuation in part of Utility application Ser. No. 12/940,478, filed on Nov. 5, 2010 which is incorporated herein by reference in its entirety.

FIELD OF THE INVENTION

The present invention relates to magnetic pickups for sensing vibrations of the ferromagnetic strings of a stringed musical instrument and, more specifically, to musical instrument pickups with components that are formed from engineered ferromagnetic materials.

BACKGROUND OF THE INVENTION

String motion sensors, commonly known as pickups, are installed on guitars, bass guitars, mandolins and other stringed musical instruments to convert the sound produced by the vibrating instrument strings to an electronic signal. In various applications, the electronic signal generated by a pickup may be modified using analog and digital signal processing techniques, amplified, and recorded on a suitable sound recording medium before being converted back to a sound signal by a speaker or other output transducer. Conventional musical instrument pickups use different physical principles, including variations in magnetic reluctance, the Hall effect and the piezoelectric effect, to detect the motion of ferromagnetic strings.

Magnetic pickups typically comprise one or more ferromagnetic pole pieces, a magnetic source, and a coil with output terminals that surrounds the pole pieces. When the pickup is positioned near the ferromagnetic strings of a musical instrument magnetic flux from the source permeates the pole pieces and other pickup components and the strings. String vibrations change the flux in the pickup and generate an electromagnetic force in the coil. An electronic signal is developed at the output terminals of the coil in response to the electromotive force.

The frequency-dependent response function of a magnetic musical pickup is nonlinear and the input string-motion signal is distorted by the pickup in the process of converting it to an electronic signal. This distortion imparts certain tonal attributes to the string-sensing process and, when properly controlled, adds desirable and highly musical qualities to the output signal.

Magnetic pickups came into common usage during the 1950's when hard ferromagnetic material and sensor technologies evolved to a point that the pickups could be economically mounted on a musical instrument. Magnetic pickups have been developed for many different instruments and a significant commercial market exists for magnetic guitar pickups. For purposes of clarity, the features of the present invention will be discussed with reference to a 6-string guitar with ferromagnetic strings. It will, however, be obvious to those skilled in the art that the scope of the invention is not limited to 6-string guitars and magnetic pickups that embody features of the invention may be mounted on many different instruments. Other instruments that are commonly equipped with magnetic pickups include, but are not limited to 12-string guitars, bass guitars, mandolins, and steel guitars.

Magnetic musical instrument pickups may classified into broad categories that reflect differences in basic design and tonal quality. Pickups in the 'single coil' category have key design features that are shared by the pickups disclosed in U.S. Pat. No. 2,612,072 issued to H. de Armond on Sep. 30, 1952, U.S. Pat. No. 2,573,254, No. 2,817,261, No. 3,236,930, and No. 4,220,069 respectively issued to Leo Fender on Oct. 30, 1951, Dec. 24, 1957, Feb. 22, 1966, and Sep. 2, 1980 and U.S. Pat. No. 2,911,871 issued to C. F. Schultz on Nov. 10, 1959. The 'single coil' name derives from the fact that pickups in this category comprise a set of string-sensing ferromagnetic pole pieces with a magnetic flux that is linked by a single, string-sensing coil of wire. Some single coil pickups have pole pieces that are formed from magnetized hard ferromagnetic materials that generate the flux in the pickup. In other single coil designs a separate permanent magnet induces magnetic fields in the pole pieces. Single coil pickups have no means for external noise rejection and are sensitive to external electromagnetic noise sources.

The external noise sensitivity of a magnetic pickup may be significantly reduced by adding a second wire coil to the pickup. The second coil is designed to generate an electronic output signal at its terminals with a noise component that is similar to the noise output of a first coil. Noise reduction is accomplished by connecting the first and second coils so that the noise signals from the two coils have opposite phases.

Noise-reducing humbucking pickups or 'humbuckers' share key design features with the devices that are disclosed in U.S. Pat. No. 2,896,491 ('491) issued to Seth Lover in Jul. 28, 1959 and U.S. Pat. No. 2,892,371 issued to J. R. Butts on Jun. 30, 1959. Pickups in this class have at least two string-sensing coils, each linked to a separate set of string-sensing pole pieces. The magnetic field direction in the poles and the direction of signal propagation within the coils are selected so that a large portion of the string-generated signals from the two coils have an in-phase, additive relationship and a large percentage of the common-mode noise signals from the two coils have an out-of-phase, subtractive relationship. Split-blade designs such as the Lindy Fralin Split-blade pickups manufactured by Lindy Fralin of Richmond, Va. also fall into the 'humbucking' category. In most cases, the amplitude of the output signal of a humbucking pickup is greater than that obtained from a single coil pickup and the output noise signal is significantly reduced.

Noise-cancelling single coil pickups have tonal characteristics similar to those of single coil pickups and comprise a single set of string-sensing pole pieces, a string-sensing coil and a noise-cancelling coil that is connected to the string-sensing coil. Illustrative noise-cancelling single coil pickups are disclosed in U.S. Pat. No. 7,166,793 issued to Kevin Beller on Jan. 23, 2007, U.S. Pat. No. 7,189,916 issued to Christopher I. Kinman on Mar. 13, 2007, and U.S. Pat. No. 7,227,076 issued to Willi L. Stich on Jun. 5, 2007.

The design and manufacture of magnetic musical instrument pickups are described from a historical and lay engineering perspective in *The Guitar Pickup Handbook, the Start of Your Sound* by Duncan Hunter (Backbeat/Hal Leonard, New York, 2008) and *Pickups, Windings and Magnets and the Guitar Became Electric*, by Mario Milan (Centerstream, Anaheim Hills, 2007). On a more technical level, *Engineering the Guitar, Theory and Practice* by Richard Mark French (Springer, New York, 2009) contains a chapter on Guitar Electronics and a thorough treatment of musical sound quality and tone as viewed from an engineering and physics perspective.

BRIEF SUMMARY OF THE INVENTION

Materials that comprise granules of one or more ferromagnetic materials in an insulating binder have ferromagnetic properties that are unique within the context of the magnetic pickup design field. In comparison to their parent materials, bound granules typically have lower permeabilities, eddy current loss coefficients, and lower remanence values. In magnetic pickups that embody the present invention, insulator-bound granules of hard ferromagnetic hysteresis materials and/or soft ferromagnetic materials are used to optimize the pickups' output tonal properties. The bound materials that are used to practice the invention have permeability values that are smaller than those of iron powder core products and coercivity values that are less than the coercivities of ceramic permanent magnets. When a pickup embodying the invention is mounted in an instrument with ferromagnetic strings, the tonal properties of the output signal are shaped, at least in part, by the interaction of the bound material components with string-induced magnetic field variations. Because of the low conductivity of the binding material and the small size of the ferromagnetic granules, the hysteresis loss process plays a comparatively larger role in the tone-shaping interaction than in conventional materials.

Some pickups that embody the invention have at least one component that is formed from a low permeability material that comprises a granulated hysteresis material or soft ferromagnetic material and an insulating binder. The pickups further comprise at least one ferromagnetic pole piece with a string-sensing surface, a magnetic source that generates at least a portion of a primary magnetic field at the string-sensing pole piece surface, a wire coil that surrounds at least a portion of the pole piece, and a mounting structure that holds the pole piece and coil in stable relative positions and enables the pickup to be secured in a musical instrument. When the pickup is mounted in a musical instrument with ferromagnetic strings, the pickup induces a magnetic flux in the strings and generates an output signal in response to magnetic field variations that are produced by the vibration of one or more strings. The pickup component that is formed from the bound granulated ferromagnetic material is positioned to interact with steady-state and time-varying components of the magnetic field and the tone of the pickup is shaped, at least partially, by ferromagnetic losses in the bound material. The low permeability material that comprises a granulated hysteresis material or soft ferromagnetic material and an insulating binder may further comprise granules of other materials, including non-ferromagnetic conductors. By combining granules with different ferromagnetic loss properties, it is possible to adjust the tonal properties of the bound material component over a wide range.

In some embodiments, the low permeability bound material component is a pole cap that is attached to a pole piece surface. Pole caps may be attached to the upper-string sensing surface or a bottom surface of a pole piece and, in some cases, may be attached to both surfaces. Pickups embodying the invention may further comprise a ferromagnetic backplate and/or a pickup cover and, in certain cases, the backplate may be formed from a hard ferromagnetic material. Hard ferromagnetic backplates are described in U.S. application Ser. No. 13/725,344 entitled "Magnetic Instrument Pickup with Hard Ferromagnetic Backplate" that was filed on Dec. 21, 2012 and is incorporated herein by reference in its entirety. In further embodiments, a ferromagnetic backplate or pickup cover may be formed from a low permeability bound material.

The invention is further embodied in pickups with a magnetic field modifier. Magnetic field modifiers may be in any state of magnetization and be formed from hard or soft ferromagnetic materials and, in some cases, the magnetic field modifier may comprise a component that is formed from a low permeability bound ferromagnetic material.

In other embodiments of the invention, the tone of magnetic pickup is shaped by at least one composite element with two or more ferromagnetic components. Composite pickup elements have a first component that is formed from a low permeability material that comprises a granulated hysteresis or soft ferromagnetic material in an insulating binder and one or more additional components that are formed from a ferromagnetic material with properties that are different than the first material. Composite structures allow the ferromagnetic properties of a pickup element to be adjusted over ranges that are beyond the ranges of bound ferromagnetic material properties. Elements that combine low permeability bound materials and high coercivity bonded magnets, for example, can generate magnetic fields that are significantly stronger than fields generated by elements that are entirely formed from bound materials alone. The permeability of an element with one or more bound material components may also be increased through the inclusion of a component that is formed from a soft ferromagnetic material with high permeability.

Embodiments with composite elements further comprise at least one pole piece, a magnetic source, a wire coil that surrounds at least a portion of the pole piece and a mounting structure that enables the pickup to be secured to a stringed musical instrument. They may also optionally comprise a pickup cover, magnetic field modifier, and/or ferromagnetic backplate that is, in certain cases, the composite pickup element.

The invention is further embodied in a method for changing the tone of a magnetic pickup by retrofitting the pickup to include a low permeability bound component. The magnetic pickup comprises a ferromagnetic pole piece with at least one string-sensing surface such that the string-sensing surface is in proximal relationship to the strings when the pickup is mounted in the instrument, a magnetic source that generates a magnetic flux and transfers at least a portion of the magnetic flux to the ferromagnetic pole piece, a wire coil that surrounds at least a portion of the pole piece; and a mounting structure that secures the pole piece and the coil in stable relative positions and enables the pickup to be attached to the stringed musical instrument.

In certain embodiments the pickup is retrofitted by affixing a component that comprises a low permeability bound material to the pickup. The component that is affixed to the pickup may be an element that is selected from the group consisting of an upper or lower surface pole cap, a ferromagnetic loss element, a ferromagnetic backplate, a magnetized field modifier, a non-magnetized field modifier, or a pickup cover. In other embodiments a pickup may further comprise an element in the group that is formed from conventional materials and the low permeability bound component is affixed to the element.

In further embodiments, a pickup may be retrofitted by replacing a component of the pickup with a component that comprises the low permeability material. Pickups that are modified according to the invention may additionally comprise an element that is selected from a group consisting of a pole cap, a ferromagnetic loss element, a ferromagnetic backplate, a magnetized field modifier, a non-magnetic field modifier and a pickup cover and, in these cases, the component that is removed and replaced may be the element that is selected from the group.

DESCRIPTION OF THE EMBODIMENTS

Magnetic pickups that embody the invention share a set of basic operating principles that are expressed in a wide range of different designs. For purposes of clarity, the present invention will be explained using a small number of pickup designs with the knowledge that features of the invention can be appropriately incorporated into any magnetic pickup by those with skill in the art of pickup design.

Figure 1:
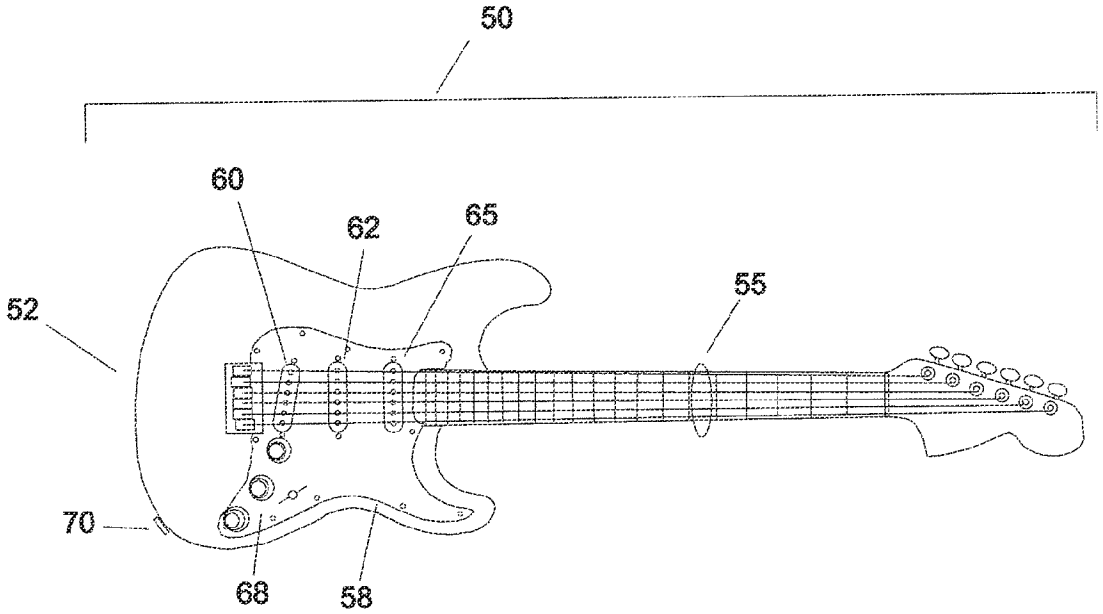
FIG. 1 is a front view of a Stratocaster-style guitar with six ferromagnetic strings and three magnetic pickups.

FIG. 1 illustrates a solid-body Stratocaster-style guitar 50 with a set of six ferromagnetic strings 55. Three magnetic pickups 60, 62, 65, that are typically single coil pickups, are mounted on a pickguard 58 that is attached to the guitar body 52 with screws. Each of the of the three magnetic pickups 60, 62, 65 generates an electronic output signal in response to the string vibrations and the pickup output terminals are connected to an electronic control circuit 68 that allows a musician to route the output signals from individual pickups or combinations thereof to an output jack 70. In most cases, the control circuit also comprises capacitors and variable resistors that are used to control the amplitude and frequency spectrum of the instrument output.

The amplitude and tonal features of the electronic output signal from a pickup that is mounted in a musical instrument are determined by the radius and composition of the strings, the detailed design features of the pickup, and the spacing between the pickup and the strings. Typically, the fidelity with which the output signal of a magnetic pickup represents the spectrum of the vibrating strings is not high and it is a common practice to describe distortions by attributing a 'musical tone' or a 'tonal quality' to the pickup.

The terms 'musical tone,' and 'tonal quality' are commonly used by those skilled in the art of musical instrument and pickup design to refer to a set of physical parameters that determine the musical qualities of the sound emanating from an instrument or component as perceived by a human observer. In this patent application, the terms 'pickup tone,' 'tonal quality,' and 'sound quality' will be used interchangeably to describe the contributions of the pickup to the perceptual features of a sound generation process. This process typically includes the conversion of the sound produced by the vibrating strings of the instrument to an electronic signal that is routed through one or more signal processing and amplification stages before being converted to sound by a speaker. Because it senses string motion and generates the electronic signal that is amplified and modified by downstream components, the sound quality of a pickup plays a significant role in determining the overall tone of an amplified instrument. Sound qualities that are lost in the process of string vibration sensing are also lost to subsequent stages of the signal processing and amplification process.

According to R. M French in the chapter of *Engineering the Guitar, Theory and Practice* entitled "Sound Quality" (pp 180-207, Springer, New York, 2009), "few topics are more controversial than sound quality. Skilled players and experienced listeners generally agree on subjective rankings of instruments, but the differences are notoriously difficult to measure and to describe using objective metrics." Like flavor, artistic quality, and other variables that describe the properties of an item in terms of its effect on human perception, good sound quality and tone are readily recognized by a knowledgeable individual but impossible to completely quantify using physical measurement parameters.

Magnetic instrument pickups generate an output signal when the magnetic flux in one or more string-sensing ferromagnetic pole pieces changes in response to the motion of an instrument string. In a typical application, the strings are magnetized by the pickup pole pieces and their vibration causes the magnetic flux in the pole pieces and other components of the pickup to vary. The pole pieces in a pickup may be formed from permanent magnets or from soft ferromagnetic materials that are magnetized by an external magnet. At least one coil surrounds the pole pieces and changes in the flux that is linked by the coil generate an electrical signal in the coil. The ends of the coil are connected to a set of output terminals that allow the pickup to be connected to the control circuit of an instrument.

It is well-known within the prior art that the tone of a pickup is affected by the size, shape and physical arrangement of the ferromagnetic components of the pickup and the number of turns, wire tensions and winding patterns of the constituent wire coils. It is also generally understood that the tone is affected by the material properties of the ferromagnetic components. In the prior art, significant levels of effort have been devoted to the development of pickups with different component arrangements and magnetic field distributions and to the optimization of winding parameters for each design. The material properties of the wire and ferromagnetic materials have, however, been largely outside of the pickup designer's control and little effort has been expended in optimizing these properties for magnetic pickup applications. In a significant majority of prior art designs, material properties have been optimized by trial and error experimentation with commercial materials that have been developed for other applications.

The inability of pickup designers to engineer the ferromagnetic material properties of pole pieces and other components has limited the tonal range of prior art magnetic pickups. The invention that was disclosed by the inventor in U.S. patent application Ser. No. 12/940,478 ('478) partially addresses this deficiency through the use of composite pole pieces that comprise two or more components with different ferromagnetic material properties. By appropriately selecting the materials and volume ratios of the components, the composite pole allows a pickup designer to create a set of composite pole pieces with tonal properties that cannot be obtained using monolithic, single material poles. The composite component concept is generally applicable to other ferromagnetic pickup components and can, for example be used to engineer the tonal properties of magnetic field modifiers of the type described in U.S. application Ser. No. 12/940,517 ('517) and ferromagnetic backplates as described in U.S. application Ser. No. 13/725,344 ('344) and these applications are incorporated herein by reference in their entirety.

In magnetic pickups embodying the present invention, the tonal range is further extended through the incorporation of engineered materials that comprise one or more granulated ferromagnetic materials and an insulating binder. The physical properties of these materials are primarily determined by the properties of the binder and, in most cases, components are easily fabricated from the bound ferromagnetic materials by molding, punching or other conventional machining operations. Their ferromagnetic properties are determined by the bulk ferromagnetic properties of the granulated materials and by their size and concentration in the binder. The bound ferromagnetic materials that are used in different embodiments of the invention are characterized by coercivity values that are smaller than those of magnetically hard ferrite materials, such as Ceramic 1, and have permeabilities that are less than those of iron powder core materials. Components that are fabricated from the engineered materials have novel, tone-shaping loss properties and, in some embodiments, can be designed to affect the magnetic coupling between the pickup and the strings of an instrument.

Because of their novel loss properties and the ease with which they can be fabricated into different shapes, the bound ferromagnetic materials of the present invention can be incorporated into a pickup in many different ways. They may, for example, be coated on one or more surfaces of a pickup or pickup cover, used as tone-modifying encapsulants for wire coils, attached to a pickup or pickup cover with an adhesive, incorporated as components of composite ferromagnetic components such as pole pieces, magnets, backplates and magnetic field modifiers, and used to make all or part of bobbins, mounting plates and other structural elements. Binding materials may be selected to meet the requirements of a specific application and include, but are not limited to, thermoplastic and thermosetting compounds of the type used in bound and flexible magnets, epoxies, polyurethane molding compounds, acrylic art media, RTV's and silicone adhesives. In many cases the incorporation of one or more granulated ferromagnetic materials in an insulating binder and the shaping of the resultant material into a pickup component are straightforward processes that can be performed by a pickup designer.

Embodiments of the present invention comprise bound granulated materials with ferromagnetic properties that fall within specified ranges. While these properties are well-known to those who work with ferromagnetic materials, they are less familiar to those in the magnetic pickup community and their definitions will be briefly reviewed briefly to facilitate a more complete understanding of the invention. Rigorous treatments of ferromagnetic material properties and the formalism that is used to describe them are found in *Ferromagnetism* by Richard M. Bozorth (IEEE Press/Wiley, Hoboken, 2003) and *Introduction to Magnetic Materials* by B. D. Cullity and C. D. Graham (IEEE Press/Wiley, Hoboken, 2008).

When a DC current passes through a long solenoidal coil with an air core, a magnetic field is generated in a direction that is parallel to the axis of the coil. The strength of the magnetic field, H, in Oersteds, is related to the current flowing through the coil, i, in amperes, by:

$$H=i(4\pi/10)(n/L),$$

where (n/L) is the number of turns per centimeter of solenoid length in the axial direction. When a core material is inserted in the solenoid, the magnetic induction within the material, B, in Gauss is related to the magnetic field, H, by the following expression:

$$B=\mu H=H+4\mu M$$

where μ is the permeability of the core material and M is magnetization of the material. The magnetization, M, reflects the contribution of magnetic domains within the material to the induction, B. Its value is dependent on the orientation of the domains (the magnetic history of the material) and on the magnitude and frequency of the magnetic field, H. In ferromagnetic materials, the permeability saturates at a value near unity at high field strengths and may be defined as the derivative of the induction, B, with respect to the field strength, H at a given value of H.

Figure 2:
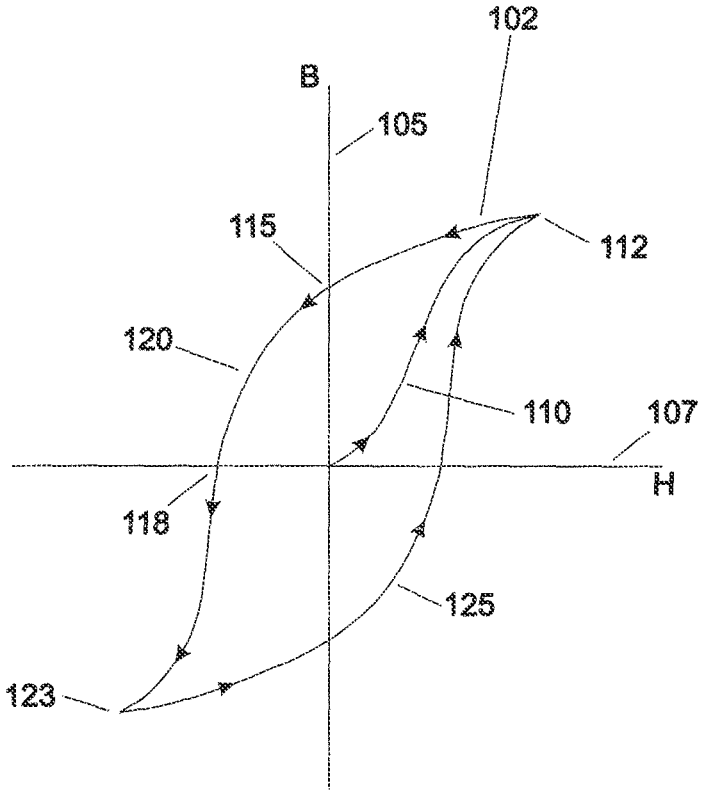
FIG. 2 is a two dimensional graph of a representative major hysteresis curve.

Ferromagnetic materials may be divided into two large classes that reflect the ease with which they are magnetized. A ferromagnetic material is said to be 'hard' if it takes an appreciable magnetic field to change the domain alignment and 'soft' if the required field is comparatively small. The stability of the magnetization in 'hard' materials makes them generally useful as permanent magnets while the 'soft' materials are commonly used as pole materials in motors and other magnetic devices and as core materials in inductors, transformers, and solenoidal antennas. The saturating field intensity is significantly larger for hard materials and the permeability significantly smaller at lower applied magnetic fields. The hysteresis curves are two-dimension graphs of the magnetic induction, B, in a ferromagnetic material as a function of an applied magnetic field, H. Curves with different shapes are generated under different applied field conditions. The major hysteresis curve is generated when the applied field is slowly cycled between large positive and negative values. The initial magnetization curve describes the transition between a zero field state in which the magnetic domains are unoriented and a saturated state in which all of the domains are aligned in the field direction. FIG. 2 illustrates a graph of the initial magnetization curve and major hysteresis curve for a representative ferromagnetic material. In this graph, the value of the magnetic induction, B, is represented along the vertical axis 105 and the value of the applied magnetic field, H, is represented along the horizontal axis 107. If the material is initially unmagnetized and the applied field, H, is equal to zero, the magnetic induction, B, is also zero and state of the material is represented by a point at the origin. As the applied magnetic field is increased, the magnetic induction increases along the initial magnetization curve 110 until the magnetization in the material saturates at point 112. While the slope of the hysteresis curve at applied fields above saturation is approximately unity, the unequal scales of the axes 105, 107 make the slope of the representative curve 102 appear smaller than unity at the saturation point 112.

If the value of H is increased beyond the saturation point 112 then decreased, the induction, B, decreases along the curve 120. The portion of the curve 120 in the second quadrant of the graph where H is negative and B takes on positive values, describes the variation of induction with applied field for a material that has been previously magnetized and, for this reason, is known as the 'demagnetization curve' for the material. Demagnetization curves for hard ferromagnetic materials are useful in the design of electromagnetic machinery and are often published by manufacturers of permanent magnet materials.

The magnetization of the previously-saturated material gives rise to a non-zero induction 115 when the strength of the applied field is equal to zero and the value of this induction is commonly referred to as the "remanence" of the material. This parameter is one of the fundamental properties used to describe permanent magnetic materials.

As the magnetic field, H, takes on increasingly negative values, the magnetic induction, B, also decreases along the curve 120 and is equal to zero at the H-axis intercept, 118. The value of the magnetic field, H, at point 118 is known as the 'normal coercive force' or 'coercivity' of the material and is commonly represented by the symbol, $H_c$. Its value is another metric that is commonly used to specify ferromagnetic materials. As the applied field, H is decreased beyond the point 118, the magnetic induction takes on increasingly negative values and eventually saturates at the point 123. When the field is decreased beyond this point and subsequently increased, the induction, B, follows the curve 125 and eventually saturates in the positive direction at the point 112.

Figure 3:
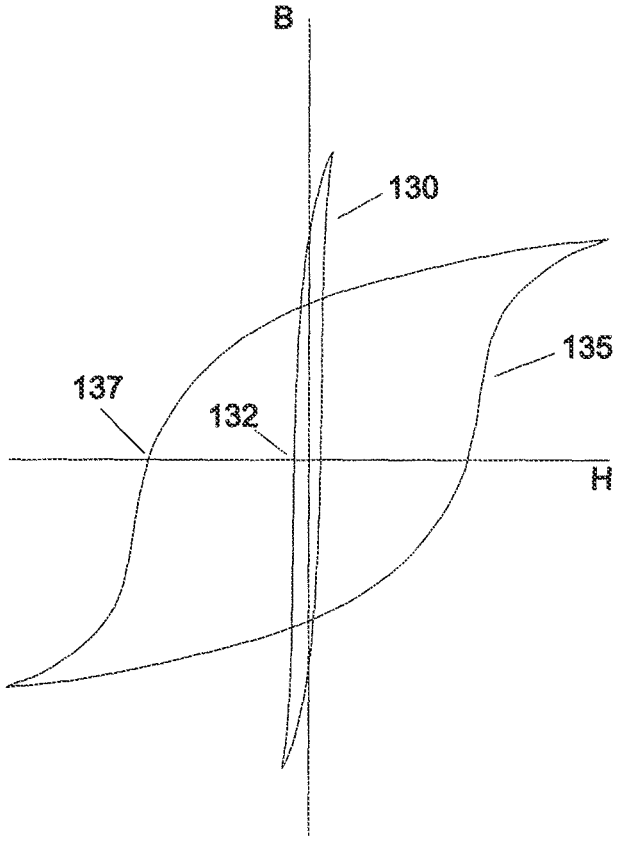
FIG. 3 is a two dimensional graph illustrating the qualitative differences in the shapes of the major hysteresis curves of hard and soft ferromagnetic materials.

The area enclosed by a hysteresis curve is a measure of the work that must be performed by the applied field as the magnetization of a material is cycled around the curve. Changing the direction of the magnetization in hard ferromagnetic materials is more difficult than in soft ferromagnetic materials and this difference is reflected in the comparatively large coercivity values and major hysteresis loop areas of the hard materials. FIG. 3 is a graph illustrating the qualitative differences in the shapes of the hysteresis curves for representative hard and soft ferromagnetic materials. The curve 130 is a representative hysteresis curve of a soft material and has a comparatively small area and coercivity, 132. The curve 135 is a representative hysteresis curve of a hard material and has a significantly larger area and coercivity, 137.

Figure 4:
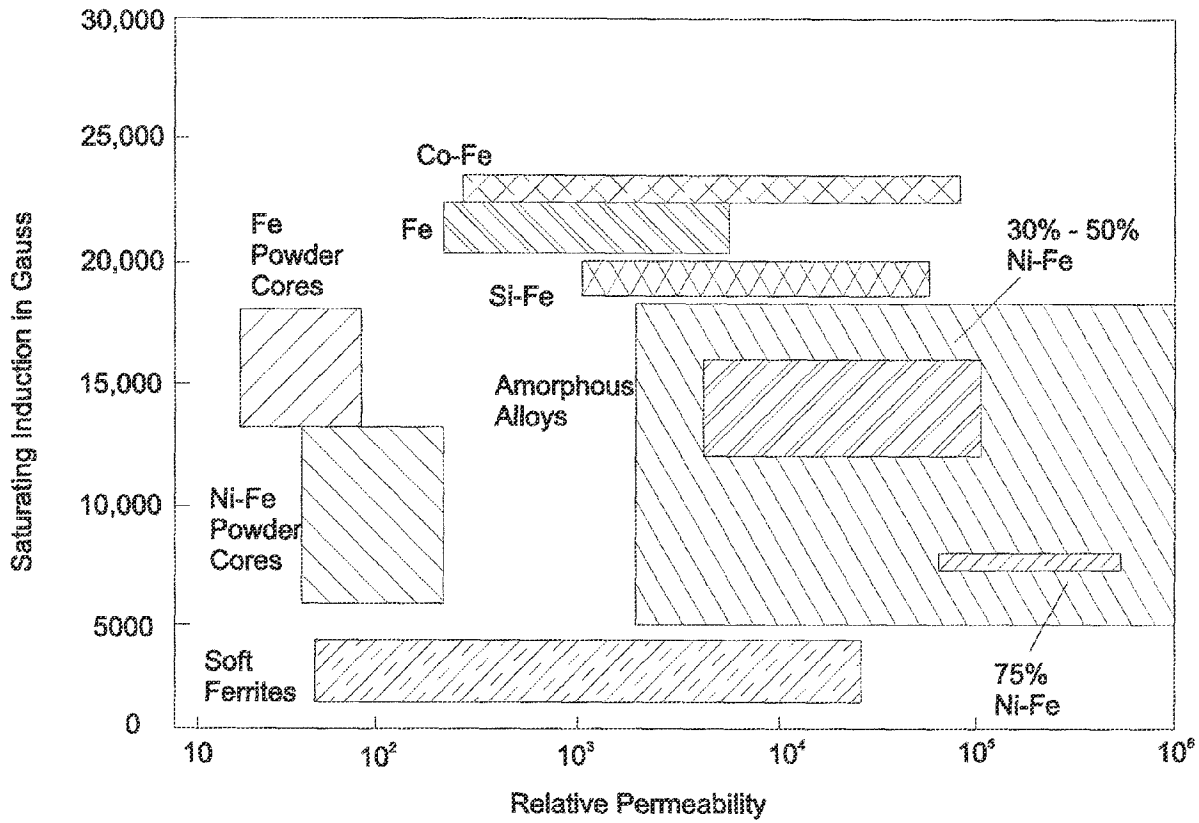
FIG. 4 is semi-logarithmic graph illustrating the saturation magnetization value and relative permeability ranges for commercial soft ferromagnetic materials.

Soft ferromagnetic materials have comparatively large values of permeability and are commonly used as core materials in transformers and chokes, magnetic pole pieces, electromagnetic shields and in other applications that require the concentration of magnetic flux. Soft ferromagnetic materials also have small normal coercivity values that reflect the responsiveness of their magnetization direction to an external magnetic field. The normal coercivity value is typically used to distinguish hard and soft materials and, in the present application, soft ferromagnetic materials are defined as having normal coercivity values that are less than 100 Oersteds (Oe). Ferromagnetic properties that are typically specified for soft ferromagnetic materials include the initial permeability for unmagnetized material in the presence of small, slowly varying magnetic fields and the field intensity at which the magnetization saturates. The variation of permeability with the strength and frequency of an external field may also be specified in addition to frequency-dependent loss coefficients. FIG. 4 is a graph that was presented originally by Steve Constantinides of Arnold Magnetic Technologies at the SMMA Fall Technical Converence in October 2008. It illustrates the ranges of saturation magnetizations values and relative permeabilities that are spanned by several classes of commercial soft ferromagnetic materials.

Figure 5:
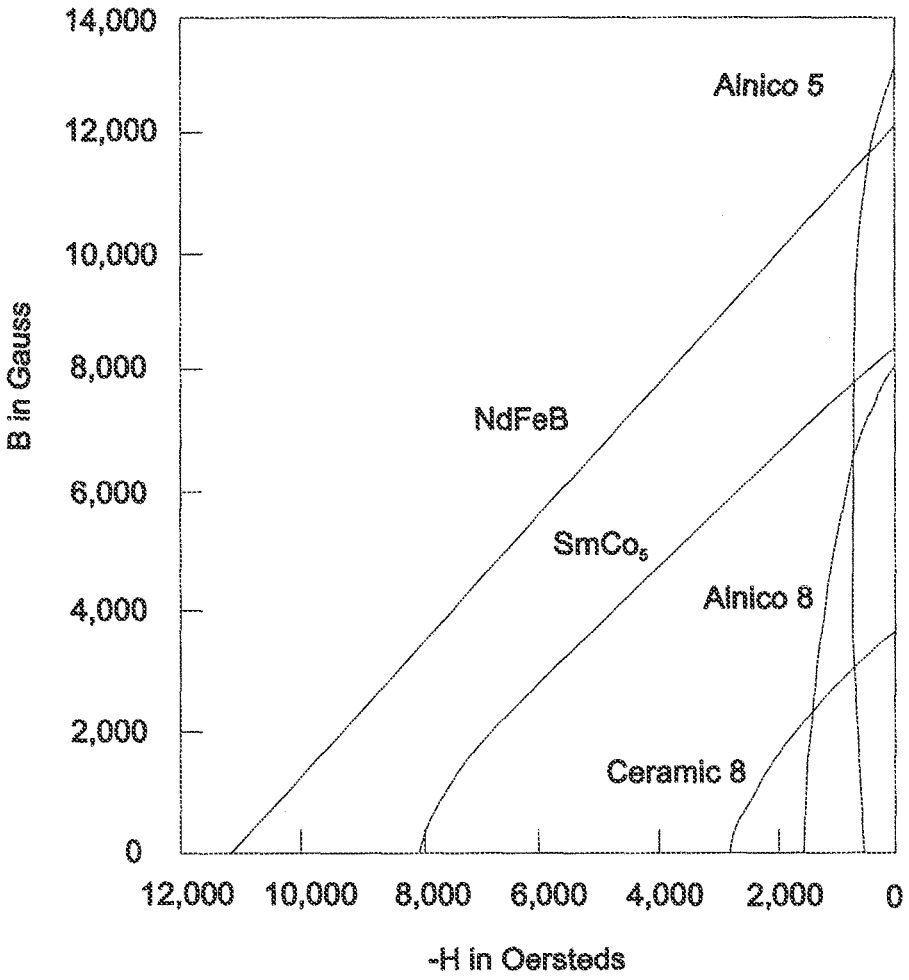
FIG. 5 is a two dimensional graph illustrating the demagnetization curves for representative materials in several hard ferromagnetic material classes.

Ferromagnetic materials with coercivities greater than or equal to 100 Oe are defined in this application as hard ferromagnetic materials. The subset of hard ferromagnetic materials with normal coercivities in the range of 100 Oe to 1000 Oe are referred to as hysteresis materials in this application. Hard ferromagnetic materials are typically used to make permanent magnets and hysteresis loss elements. Important ferromagnetic properties for these materials include remanence, coercivity, and conductivity in addition to the shape of the demagnetization curve and the maximum value for the product of induction and magnetic field. FIG. 5 is a two dimensional graph, adapted from "Modern Permanent Magnets for Applications in Electro-Technology," by Karl J Strnat, *Proc. IEEE, Vol.* 78, pp. 923 (1990), that illustrates the demagnetization curves for representative hard ferromagnetic materials. Of the illustrated materials, Alnico 5 is the only material with a coercivity that falls within the hysteresis material range.

While the ferromagnetic properties that can be extracted from major hysteresis curves and initial magnetization curves of the type illustrated in FIG. 3 are useful for many applications, additional parameters are needed to describe the behavior of ferromagnetic materials that are subjected to small variations in the applied field. In a magnetic pickup, for example, the pole pieces are typically maintained at a fixed magnetic bias and the vibrating strings produce small, audio frequency perturbations in the bias field. Under these conditions, the induction in the material deviates from the slowly-varying major hysteresis curves illustrated in FIGS. 2 and 3 and are more accurately described by minor or recoil hysteresis loops. Minor hysteresis loops are typically observed for hard and soft ferromagnetic materials that are subjected to small perturbations of steady-state magnetic fields in all quadrants of the major hysteresis loop graph.

Figure 6:
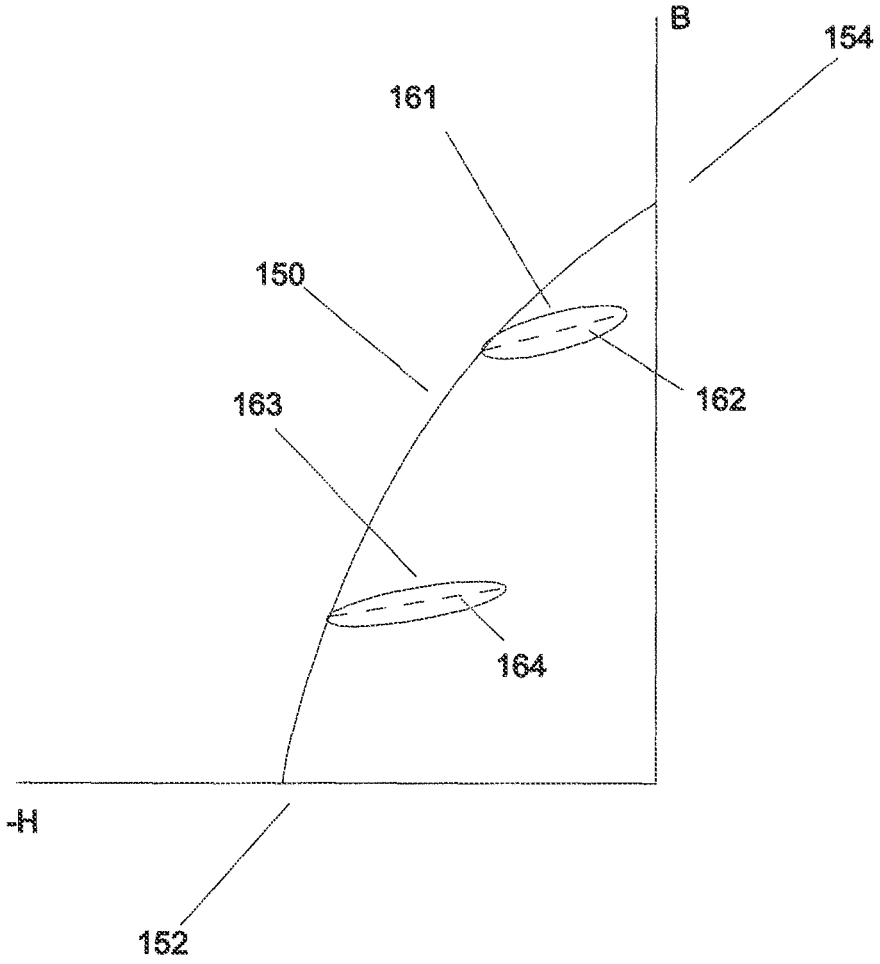
FIG. 6 is a two dimensional graph illustrating the demagnetization curve and several recoil hysteresis loops for a representative hard ferromagnetic material.

FIG. 6 illustrates the demagnetization curve 150 and a set of recoil hysteresis loops 161, 163 for a hard ferromagnetic material such as Alnico 3 that has been initially magnetized to saturation by the applied field. The coercivity, H, of the illustrated material is equal to value of the applied field at the H-axis intercept 152 of the demagnetization curve 150 and the remanence, $B_r$, is equal to the value of the induction at the B-axis intercept, 154. The recoil hysteresis loops 161, 163 describe the behavior of the material when the applied field is fixed at different bias values and cycled over a small range. The slopes of the major axes 162, 164 of the recoil hysteresis loops 161, 163 are equal to the recoil permeabilities values for the material at the corresponding bias field strength. The energy required to cycle the magnetization around a recoil loop is known as the recoil hysteresis loss and is proportional to the recoil loop area. In most materials, the recoil hysteresis loss increases with the magnitude of the biasing field.

In a typical magnetic pickup, the ferromagnetic components are subjected to DC bias fields and small, audio frequency fields with frequencies and magnitudes that are determined by the string vibrations. In a typical Stratocaster-style single coil pickup with fully magnetized Alnico 5 pole pieces, for example, the magnetic induction at the pole ends has a bias value of approximately 1000 Gauss and the vibration of the ferromagnetic strings generate audio frequency perturbations in the bias field that are described by recoil hysteresis loops. The energy expended in moving around the loops represents a loss to the system and the nonlinearity of the recoil process adds harmonics to the audio spectrum of the string-induced field perturbations.

Time-varying magnetic fields in conductive ferromagnetic materials also generate eddy currents that result in additional frequency-dependent losses. Eddy current losses are approximately proportional to the square of the perturbing field frequency and increase with the conductivity and maximum dimension of a component in a plane that is approximately perpendicular to the varying magnetic field.

In a magnetic pickup, the spectrum of the string-induced magnetic field variations is modified by hysteresis and eddy current losses in the pole pieces, magnets and other pickup components. The pickup tone is, therefore, significantly affected by the composition, fabrication and magnetic history of ferromagnetic pickup components. It is well known, for example, that the tonal properties of Alnico pole pieces are supplier-dependent and that otherwise-identical components that are fabricated with material from different foundries will typically have different tonal properties. Designers of prior art pickups have typically optimized the loss parameters of ferromagnetic pickup components by the trial-and-error auditioning of commercially-available materials.

In pickups that embody the present invention, one or more components are formed from ferromagnetic materials with loss properties that can be engineered to obtain ferromagnetic material properties that are outside of the parameter space of prior art pickup materials. The novel materials comprise at least one granulated ferromagnetic material and an insulating binder and can, in most cases, be manufactured by a pickup designer or component manufacturer. Their eddy current and hysteresis losses are determined by the bulk properties of the granulated materials and by their concentrations, sizes, and magnetization states in the binder. Suitable insulating binders include, but are not limited to, epoxies, urethane molding compounds, acrylic media, silicone adhesives, RTV's in addition to the thermosetting and thermoplastic compounds that are used in the fabrication of flexible and bonded magnets.

The bound materials of the present invention incorporate granules that are formed from a hysteresis or soft ferromagnetic material and have low initial permeabilities. These values are typically less than the initial permeabilities of commercial iron powder materials that are manufactured, for example, by Micrometals of Anaheim, Calif. Hysteresis materials have normal coercivity values that are less than those of hard ferromagnetic ferrites and are numerically less than or equal to 1000 Oe. Numerically, the bound granular materials that are incorporated in the embodiments of the invention have initial permeabilities that are less than or equal to 10 and normal coercivity values are less than or equal to 1000 Oersted.

Granules of hysteresis and soft ferromagnetic materials are typically produced by crushing or grinding bulk materials. When granules of a specific material are incorporated into an insulating binder, the eddy current loss coefficients are typically reduced by a large factor in comparison to the eddy current coefficients of the granules' bulk source material. The hysteresis loss coefficient is affected to a much smaller degree and, therefore, accounts for a larger percentage of the ferromagnetic losses in the bound material.

The loss properties of a bound ferromagnetic material may be engineered by varying the composition and concentration of the ferromagnetic granules in the material. Novel hysteresis loss characteristics may be obtained, for example, by combining granules of two or more ferromagnetic materials in a single material and eddy current losses may be increased through the addition of nonferromagnetic conductive granules. The magnitude of the loss and associated tonal variation that is generated in a pickup by a bound material component is partially determined by the shape, volume and position of the component and by the concentration of the granules in the material. The tonal properties of bound material components have also been found to vary with the binding material.

Magnetic pickups that embody the present invention have tonal properties that are determined, at least in part, by the interaction of the time-varying magnetic fields that are generated by vibrating instrument strings with one or more pickup elements that incorporate low permeability materials that comprise granules of at least one hysteresis or soft ferromagnetic material in an insulating binder. In different embodiments, the elements of inventive pickups may have structures that are monolithically formed from a bound granulated material or they may have composite structures with one or more bound granulated material components.

Figure 7:
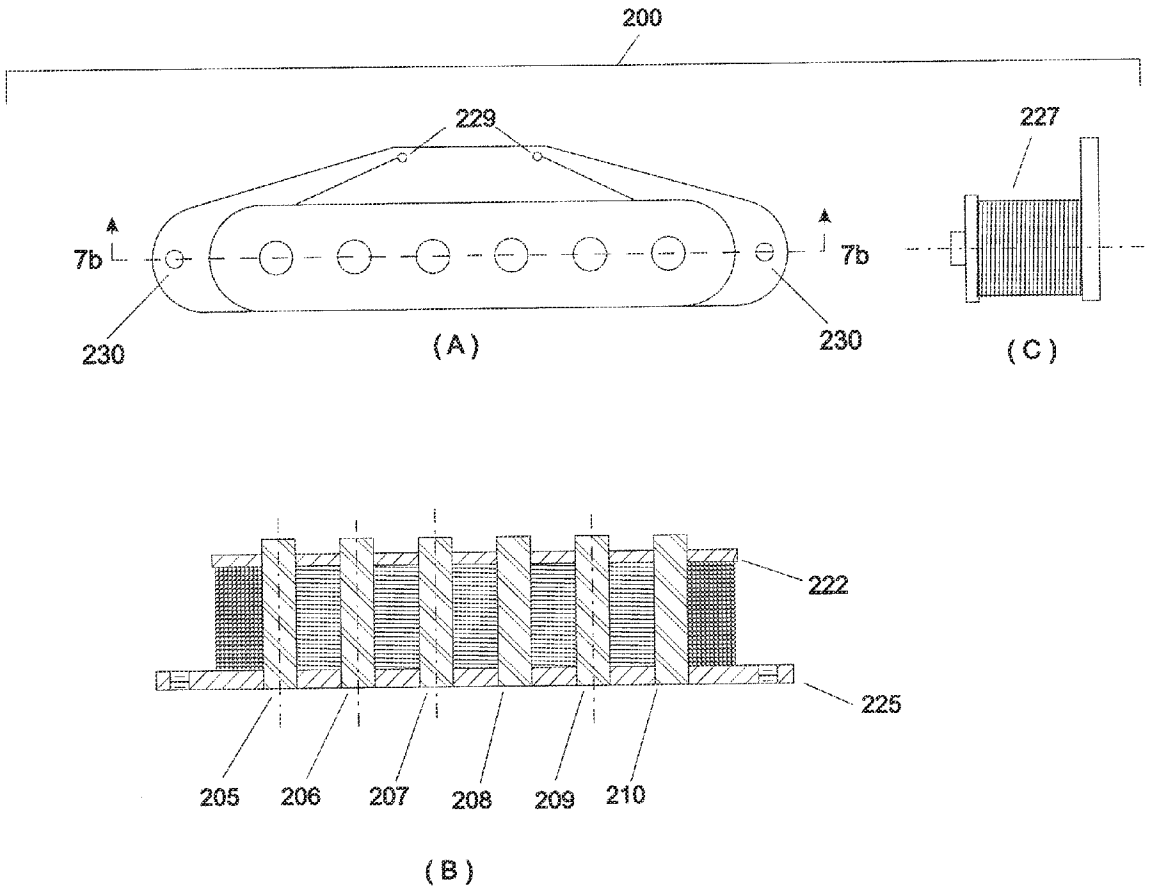
FIG. 7(A) is a top projection view of a conventional Stratocaster-style single coil pickup.
FIG. 7(B) is a front sectional view of the conventional Stratocaster-style single coil pickup taken along the line 7*b* in FIG. 7(A).
FIG. 7(C) is a side projection view of the conventional Stratocaster-style single coil pickup.

FIG. 7(A)-(C) is a sectioned orthographic projection drawing of a conventional single coil pickup 200. Pickups of this design are commonly installed in Stratocaster-style guitars that are similar in design to the guitar 50 that is illustrated schematically in FIG. 1. The magnetic field in the pickup 200 is generated by magnetized pole pieces 205-210 that are typically formed from a cast Alnico alloy such as Alnico 5. The diameters of the pole pieces in conventional Stratocaster-style single coil pickups are typically between 0.187"-0.250" and the pole piece lengths commonly range from 0.625" to 0.780". The pole lengths are approximately equal in the pickup 200 but may be staggered in alternative designs. The pole pieces 205-210 are pressed into holes in an upper end plate 222 and a lower end plate 225 to form mechanically-stable assembly. The endplates are formed from an insulating structural material such as Forbon. The wire coil 227 is wound directly on the pole pieces 205-210 and laterally constrained by the end plates 222, 225. In a typical design, the coil 227 has approximately 8000 turns of number No. 42 wire that is insulated with one or more layers of a conventional insulating material such as Formvar, plain enamel or polyurethane. The ends of the wire coil 227 are connected to conductive eyelets 229 that facilitate connecting the pickup to the control circuit of a guitar and threaded holes 230 in the bottom end plate 225 allow the pickup to be secured to a guitar in a conventional fashion.

Single-coil pickups that are similar in design to the pickup 200 have tonal properties that primarily determined by the number of turns and winding parameters of the coil 227 and by the dimensions, magnetization and ferromagnetic loss properties of the pole pieces, 205-210. Poles that are formed from different Alnico alloys, such as Alnico 2, 3, 4, and 5, that have characteristic tonalities that vary with their length, diameter and manufacturer.

Figure 8:
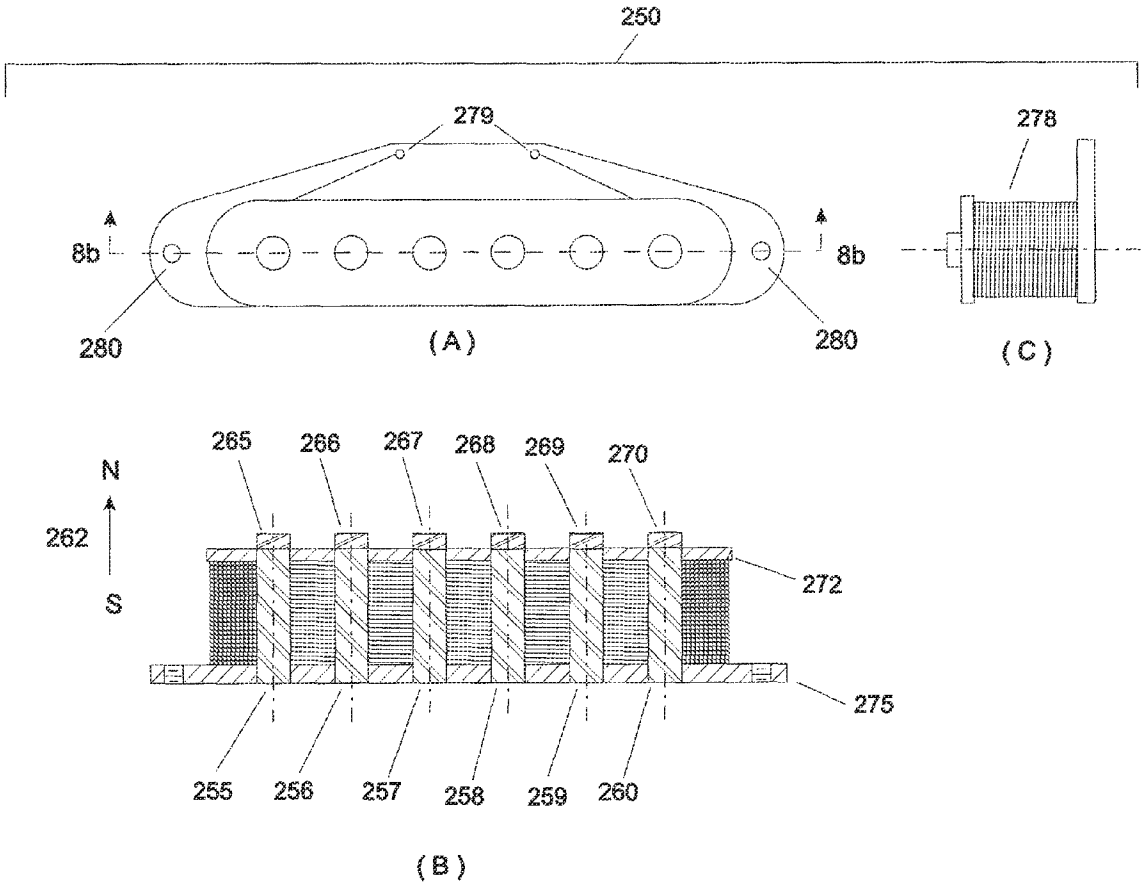
FIG. 8(A) is a top projection view of a Stratocaster-style single coil pickup with pole caps that embodies features of the invention.
FIG. 8(B) is a front sectional view of the inventive single coil pickup taken along the line 8*b* in FIG. 8(A).
FIG. 8(C) is a side projection view of the inventive single coil pickup.

In certain embodiments of the invention, the loss properties of the single coil pickup 200 may be altered by fabricating at least a portion of one or more pole pieces from a low permeability material that comprises a granulated hysteresis or soft ferromagnetic material and an insulating binder. FIG. 8(A)-(C) illustrates a Stratocaster-style single coil pickup 250 with capped pole pieces that embody features of the invention. Each of the composite pole pieces in the pickup 250 have upper and lower components that are similar in size and composition to the components of the other pole pieces. In a representative embodiment, the lower components, 255-260 are formed from Alnico 5 with radii of approximately 0.187" and lengths of approximately 0.671" that is fully magnetized with the polarity indicated by the arrow 262. The upper components 265-270 are approximately 0.187" in diameter and have thicknesses of approximately 0.025" and are formed from granulated Alnico 3 that is incorporated in an epoxy binder in the approximate volume ratio of 1:8. Pole piece components that comprise the top or bottom surfaces of a pole piece and have thicknesses that are less than 0.125" are referred to in this application as pole caps. In the pickup 250, the upper pole caps 265-270 are initially in an unmagnetized state before being attached to the lower components but, in alternative embodiments, they may be in partially or fully magnetized states.

The pole caps 255-260 in the illustrated pickup 250 are monolithic, but, in other embodiments, they may have two or more components. Composite pole caps with novel and interesting tonal properties may, for example, be produced by mounting a disc of bound granulated ferromagnetic material on a solid disc of that is formed from a ferromagnetic material. Bound Alnico alloy granules and thin discs of soft ferromagnetic materials such as grain-oriented Si steel and high carbon steel, for example, may be combined to obtain pole caps with interesting tonal properties. Small quantities of non-ferromagnetic materials with high conductivity, including copper, brass, nickel, and aluminum, may also be added to pole caps in solid or granular form to increase their eddy current losses.

Because of their small thickness and position within a composite pole piece, pole caps may be attached to other pole piece components in a manner that facilitates their removal and replacement by a musician or luthier. In the pickup 250, for example, the pole caps 265-270 may be attached to the lower pole piece components 255-265 by layers of a repositionable adhesive or a press-and-stick decal adhesive.

In the illustrated embodiment, the lower pole piece components 255-260 are conventionally pressed into holes in the upper endplate 272 and lower endplate 275 to form a stable mechanical assembly. The endplates are fabricated from Formvar or an alternative insulating structural material. The conventional wire coil 278 comprises approximately 8000 turns of #42 heavy Formvar wire and is wound directly on the lower pole piece components 255-260. The coil is terminated in conductive ferrules 279 in the lower endplate 275 and threaded mounting holes 280 allow the pickup assembly to be conventionally mounted in a guitar.

In alternative embodiments of the invention, at least one of the pole pieces includes a component that is formed from a material that comprises a granulated hysteresis or soft ferromagnetic material and an insulating binder. The pole piece that comprises the bound granulated material may be monolithically formed from the material or it may be a composite structure that includes two or more components with different ferromagnetic material properties. Tonal qualities that are different than those that can be obtained with prior art materials are typically optimized by varying the size, composition, and magnetization states of pole piece components that are formed from bound granulated materials.

Figure 9:
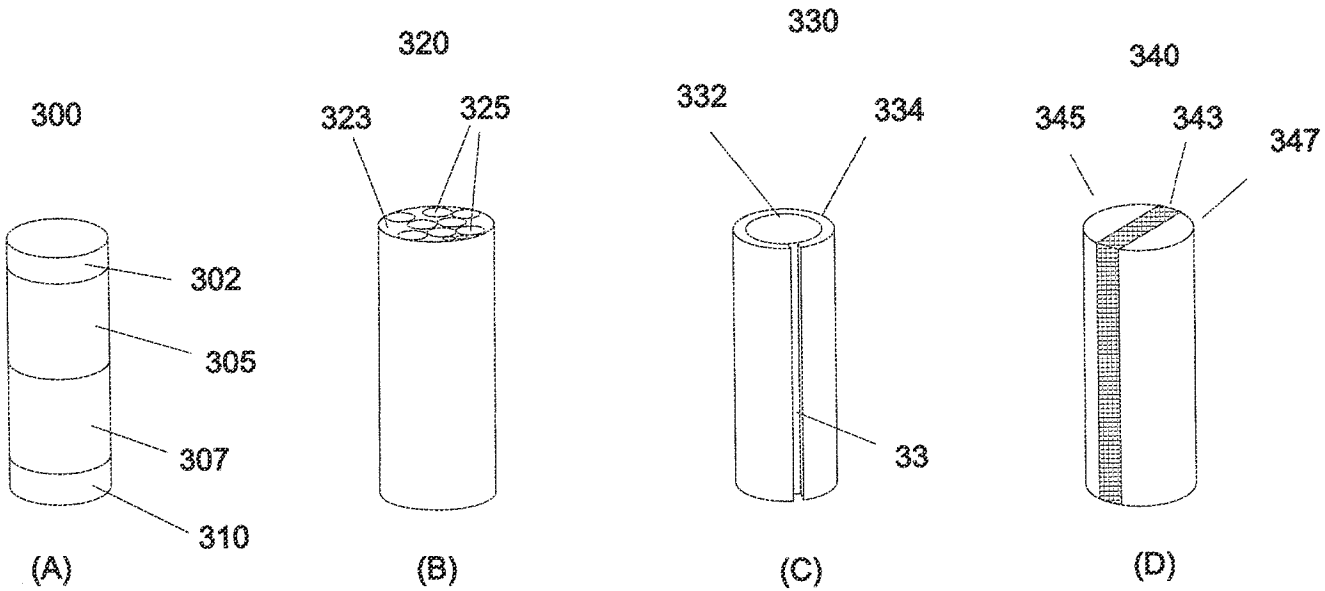
FIG. 9(A) is a perspective drawing of a stacked cylindrical composite pole embodying features of the invention.
FIG. 9(B) is a perspective drawing of a cylindrical composite wire pole piece embodying features of the invention.
FIG. 9(C) is a perspective drawing of a cylindrical composite pole piece with nested components embodying features of the invention.
FIG. 9(D) is a perspective drawing of a cylindrical composite pole piece with a planar core embodying features of the invention.

FIG. 9 (A)-(D) schematically illustrate alternative cylindrical composite pole designs that comprise granulated hysteresis or soft ferromagnetic materials and an insulating binder. The pole piece 300 is a stacked design with four cylindrical components 302, 305, 307, 310. At least one of the components is formed from a bound granulated material and, within this constraint, tonal properties of the pole piece 300 may be engineered over a wide range by varying the dimensions, composition, and magnetization states of the components. In a representative design, for example, the upper pole cap 302 is formed from a mixture of Alnico 4 and iron granules in an epoxy binder and the bottom pole cap 310 is formed from Alnico 2 granules in a flexible polyurethane molding compound. The central components 305 and 307 are formed from fully-magnetized Alnico 5 and 330 alloy stainless steel respectively. All of the pole piece components are approximately 0.187" in diameter and the length of the magnetized Alnico 5 component 305 is approximately 0.438". The 330 alloy Stainless Steel component 307 is approximately 0.25" long while the Alnico 2 bound granule component 310 and Alnico 4-Fe component 302 have respective lengths of approximately 0.125" and 0.030." The central components 305, 307 are typically joined with a high strength adhesive such as Loctite 392. The components 302, 310 may also be permanently joined to the central components with a high strength adhesive or, in a typical case in which they lie above and below the pickup endplates, they may be removably attached with a conventional repositionable adhesive.

FIG. 9(B) illustrates a composite pole piece 320 that comprises a number of solid wire components 325 that are held together by a bound granular ferromagnetic material 323. In different embodiments, the wire components 325 may be formed from a range of materials, including ferromagnetic materials and non-ferromagnetic conductors, and may have different radii and compositions. In a representative design, a combination of low and high carbon steel wires with diameters between 0.010" and 0.025" are embedded in an epoxy that is loaded with Alnico 5 granules in the volume ratio of 1:15.

FIG. 9(C) illustrates a composite pole piece 330 that comprises a cylindrical central core 332 and a tubular sheath 334. At least one of the components is fabricated from a bound ferromagnetic material and, the tubular sheath may optionally have one or more slits 337 to reduce eddy current losses. In a representative design, the core 332 is fabricated from a low carbon steel such as 1010 or 1018 alloy steel, and has a diameter of approximately 0.125." The solid jacket has a wall thickness of approximately 0.030" and is formed from granulated Alnico 3 powder in an epoxy binder. The lengths of both components are approximately 0.671." Because of the low conductivity and eddy current losses of the epoxy-bound Alnico 2 material, the optional slit 337 is absent in this design. In an alternative design, the core 332 is approximately 0.090" in diameter and is formed from iron filings that are incorporated in an epoxy binder in a 2:1 ratio by volume. The jacket 334 is formed from low carbon steel tube with a wall thickness of 0.050" and has a single slit 337 that is approximately 0.030" wide.

FIG. 9(D) illustrates a composite pole piece 340 that comprises a central core 343 that is sandwiched between two outer sections, 345, 347. In embodiments of the invention, the core 343 or one of the sections 345, 347 is fabricated from a low permeability material that comprises granules of a hysteresis or soft ferromagnetic material and an insulating binder. In a representative example, the overall diameter of the pole piece 340 is approximately 0.187" and the central core comprises six laminated sheets of 0.006" thick grain oriented Si-steel. The two outer sections 345, 347 are fabricated from granulated Alnico 4 that is incorporated in an epoxy binder. In addition to a component that comprises a granulated ferromagnetic material in an insulating binder, alternative embodiments may include components that are formed from homogeneous solid materials or from wires that are embedded in a binder.

Figure 10:
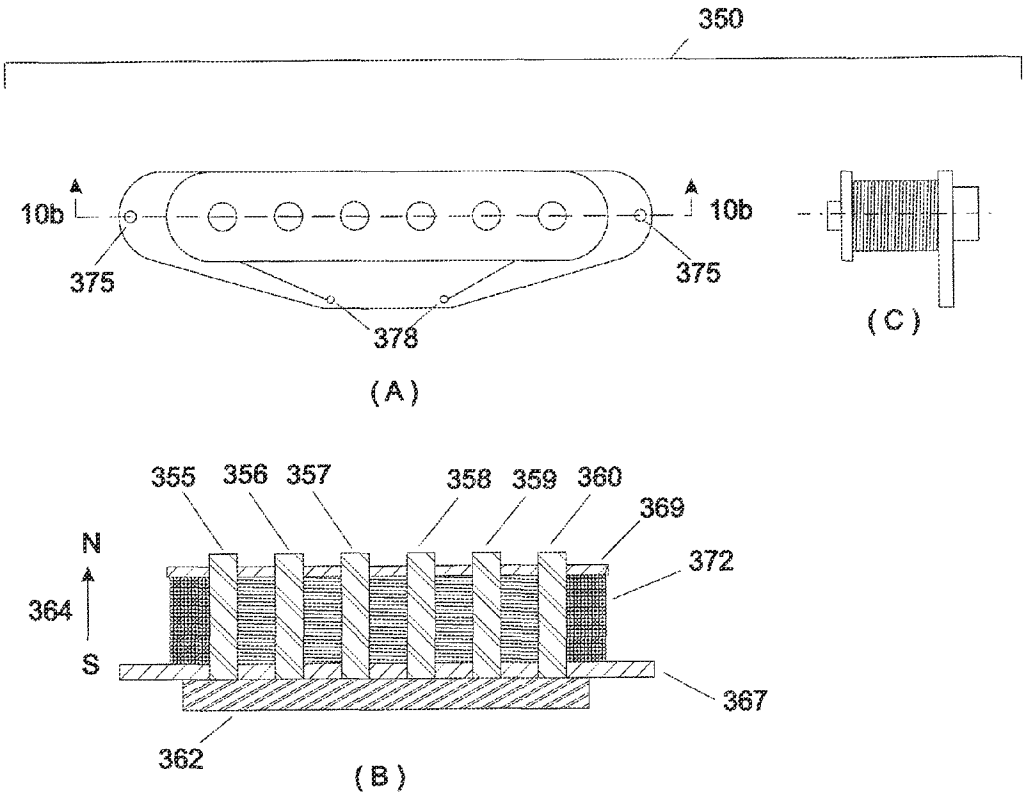
FIG. 10(A) is a top projection view of a Stratocaster-style single coil pickup with soft ferromagnetic pole pieces and a magnetized hard ferromagnetic backplate.
FIG. 10(B) is a sectional view of the single coil pickup and magnetized backplate taken along the line 10*b* in FIG. 10(A).
FIG. 10(C) is a side projection view of the single coil pickup and magnetized backplate.

In addition to designs that are based on self-magnetized pole pieces, conventional single coil pickups may have pole pieces that are formed from soft ferromagnetic materials and coupled to one or more permanent magnets. FIG. 10(A)-(C) is a sectioned orthographic projection drawing of a single coil pickup 350 with six soft ferromagnetic pole pieces 355-360 that are coupled to the permanent ceramic magnet 362. The permanent magnet 362 is magnetized in the vertical direction as indicated by the arrow 364. The pole pieces 355-360 are pressed into an upper endplate 369 and a lower endplate 367 that are made from Forbon or other conventional material and threaded holes 375 in the lower endplate 367 allow the pickup to be conventionally mounted on a guitar. The wire coil 372 is wound on the pole pieces 355-360 and terminated in metal ferrules 378. In a representative conventional pickup the magnet 362 is formed from a hard ferrite such as Ceramic 8 and the pole pieces are formed from a low carbon steel such as 1018 alloy steel.

In pickups that embody the invention, the pole pieces 355-360 comprise at least one component that comprises granules of a hysteresis or soft ferromagnetic material and an insulating binder. Advantageously, the pole pieces that comprise the bound granules have composite structures with one or more high permeability components that efficiently transfer magnetic flux from the permanent magnet 362 to the upper, string-sensing surfaces of the pole pieces. In a representative embodiment, the magnet 362 is formed from Ceramic 8 material and is 0.50" wide×2.375" long×0.188" thick. Each of the pole pieces 355-360 comprises a 0.625" long cylinder of 1018 alloy steel and a 0.030 thick pole cap that is formed from an epoxy that is loaded with iron filings. The volume ratio of the iron filings in the epoxy binder is approximately 1:3 and all pole piece components are approximately 0.187" in diameter. In alternative embodiments the pole pieces 355-360 may have different designs and structures that include, but are not limited to the structures that are illustrated in FIG. 9.

Figure 11:
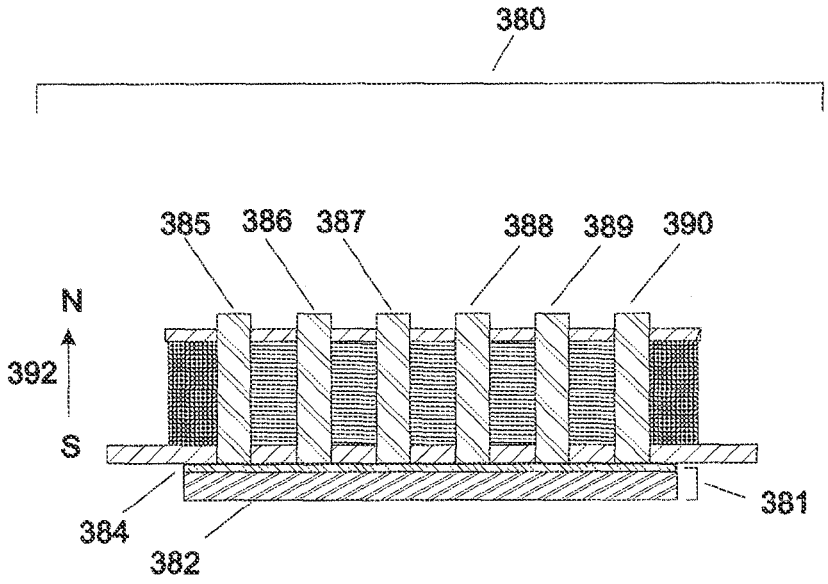
FIG. 11 is a sectional view of a single coil pickup with soft ferromagnetic pole pieces and a composite magnet backplate.

Pickups according to the invention may also have monolithic poles that are formed from a solid ferromagnetic material and magnets that comprise one or more components that are formed from granular hysteresis or soft ferromagnetic materials in a binder. The magnet 362 may, for example, be formed from a flexible or bonded material that comprises highly magnetic ferrite or NdB granules and granules of a hysteresis material such as Alnico 3 or 4. Alternatively, the magnet 362 may have a composite structure that comprises a component that is formed from a hard ferrite or high coercivity rare earth material and at least one component that is formed from a low permeability granulated material in a binder. In a typical composite magnet pickup, the bound material is located between the permanent magnet and the pole pieces. FIG. 11 is a sectioned front view of a pickup 380 with a composite magnetic flux source that is, in other respects, identical to the conventional pickup 350. The magnetic source 381 comprises a 0.187" thick ceramic 8 permanent magnet 382 and a 0.040 thick sheet of granulated Alnico 2 in an insulating binder 384. In the illustrated embodiment, the pole pieces 385-390 are formed from 1018 alloy carbon steel and the ceramic magnet is magnetized in the direction of the arrow 392.

Figure 12:
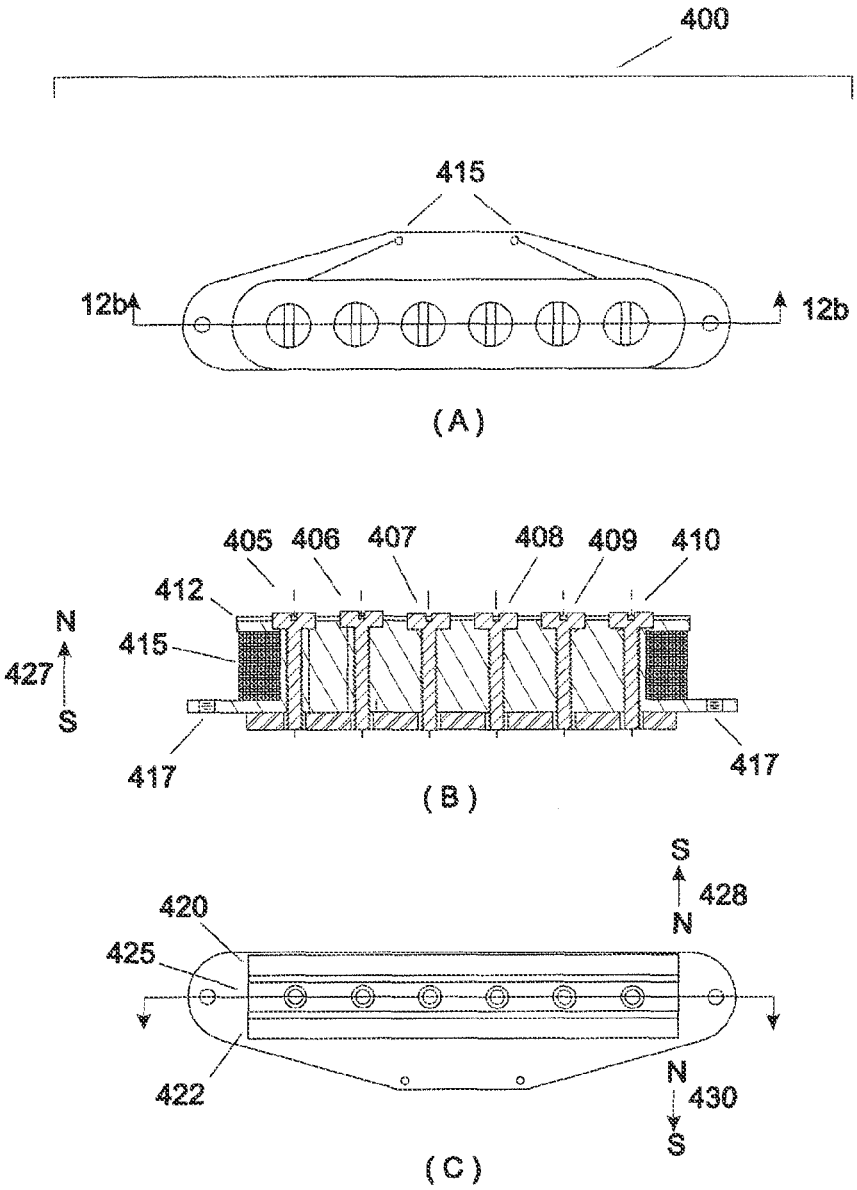
FIG. 12(A) is a top projection view of a single coil pickup with screw pole pieces and composite magnetic flux sources that embodies features of the invention.
FIG. 12(B) is a sectional view of the single coil pickup with screw poles taken along the line 12*b* in FIG. 12(C).
FIG. 12(C) is a bottom projection view of the single coil pickup and composite flux sources.

FIG. 12(A)-(C) is a sectioned orthographic projection drawing of a single coil pickup 400 that further embodies the invention. In the pickup 400, the conventional soft ferromagnetic screw pole pieces 405-410 are threaded into a bobbin 412 that is formed from an insulating plastic or other conventional material. The conventional wire coil 415 comprises approximately 7600 turns of No. 43 wire and is wound on the bobbin 412 and is connected to conductive ferrules 415 in the lower plate of the bobbin that facilitate connection of the pickup to the control circuit of a guitar. Threaded holes 417 in the lower plate of the bobbin 412 allow the pickup to be conventionally mounted in a Stratocaster-style guitar.

A magnetic field is induced in the screw pole pieces 405-410 by the permanent composite magnets 420, 422 and a keeper bar 425 that efficiently transfers magnetic flux from the magnets to the screws. Each of the composite permanent magnets 420, 422 comprise outer and inner components and at least one of the components is formed from a granular hysteresis or soft ferromagnetic material and an insulating binder. In a representative embodiment, for example, the outer components are Ceramic 8 permanent magnets and the inner components are formed from a mixture of Alnico 4 and iron granules in an epoxy binder. The compound magnets 420, 422 have common dimensions of approximately 0.187" in a direction perpendicular to the plane of the bottom bobbin surface and cross-sections that are approximately 0.25" wide and 2.375" long. The Ceramic 8 components are attached to the bottom surface of the bobbin 412 and oriented with their North poles directed towards the keeper bar 425 as indicated by the arrows 428, 430. The conventional keeper bar 425 is formed from a low carbon steel such as 1010 alloy steel and is approximately 0.187" square×2.375" long. The holes in the illustrated keeper bar 425 are drilled to provide tight clearance for the screw pole threads but, in other embodiments, may be threaded.

In alternative screw pole embodiments, single coil pickups with designs similar to the pickup 400 may incorporate other components that are formed from a material that comprises a granulated hysteresis or soft ferromagnetic material and an insulating binder. In embodiments with monolithic permanent magnets 420, 422, for example, the keeper bar 425, pole pieces 405-410 or bobbin 412 may be formed, at least in part, from a bound ferromagnetic material.

Figure 13:
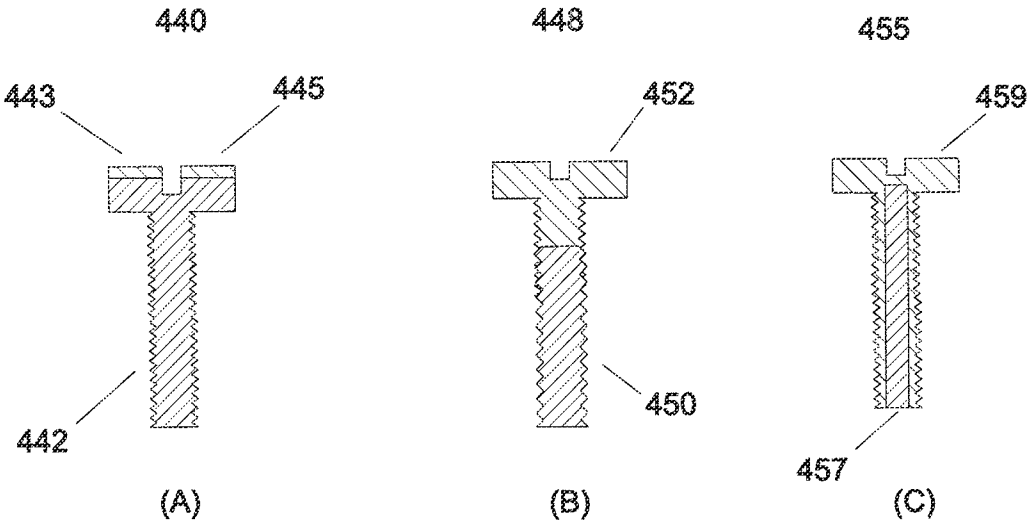
FIG. 13(A) is a sectional front view of a capped composite screw pole.
FIG. 13(B) is a sectional front view of a stacked composite screw pole.
FIG. 13(C) is a sectional front view of a composite screw pole with a central core.

FIG. 13(A)-(C) are sectioned front views of composite screw pole designs that comprise a high permeability solid ferromagnetic material component and a bound granular material component may be used for the pole pieces 405-410 in monolithic permanent magnet embodiments of the pickup 400. FIG. 13(A) illustrates a capped screw pole 440 with a threaded body 442 and two caps 443, 445 that are formed from a bound granular material. In a representative example, the screw body 442 is formed from a low carbon steel alloy and the caps are formed from iron filings that are incorporated in a 3:16 volume ratio in medium thickness acrylic art gel. FIG. 13(B) illustrates an alternative composite screw pole piece 448 in which an upper section 452, that comprises the screw head and a portion of the threaded shaft, is bonded to a lower threaded shaft section 450. The lower shaft section 450 is typically formed from a high permeability solid material and the upper section 452 from a low permeability bonded material. FIG. 13(C) illustrates an alternative composite pole piece pole piece 455, in which a high permeability rod 457 is imbedded in a bound material component 459 that comprises the screw head and threads.

Pickups that embody the invention and have soft ferromagnetic pole pieces and permanent magnet configurations that are similar to the magnet configuration in the single coil pickup 400 may incorporate cylindrical, non-threaded composite pole pieces that are similar to the pole pieces illustrated in FIG. 8(A)-(C) and FIG. 9(A)-(C). In a typical design, the cylindrical poles are directly side-coupled to the permanent magnets 420, 422 and the keeper bar 425 is eliminated. Pickups that are similar in design to the pickup 400 may also incorporate pole pieces that comprise at least one fixed cylindrical component and a screw component as illustrated in the sectional front view drawings of FIG. 14(A)-(B). The pole piece 460 that is illustrated in FIG. 14(A), for example, comprises a cylindrical threaded sleeve 465 and a screw 467. At least one of the sleeve 465 and screw 467 are fabricated from a bound ferromagnetic material and, in a representative example, the sleeve is formed from a mixture of high permeability soft ferrite and Alnico 2 granules in epoxy and the screw is formed from a low carbon steel.

The pole piece 470 that is illustrated in FIG. 14(B) comprises a lower cylindrical body component 472, an upper cylindrical sleeve, and a screw 477. At least one of the components 472, 475, 477 is formed from a bound ferromagnetic material and, in a representative example, the screw 477 and the lower cylindrical component 472 are formed high permeability soft ferromagnetic materials and the upper sleeve is formed from a bound ferromagnetic material. In alternative embodiments, one or both of the upper component 475 and the lower component 472 may be formed from high permeability soft ferromagnetic materials while the screw 477 is formed from a bound ferromagnetic material. In those cases where the screw component does not extend beyond the bottom surface of the threaded portion, pole pieces that are similar in design to the pole pieces 460, 470 may also be incorporated into the pickup 350 that is illustrated in FIG. 10(A)-(C).

Backplates that are formed from soft ferromagnetic or non-ferromagnetic materials are conventionally attached to single coil pickups to modify the magnetic field distribution, increase eddy current losses, and reduce the coupling of electromagnetic noise into the pickup. A low carbon steel backplate that is coated with a thin layer of copper is, for example, a standard design feature of the bridge pickup of many Telecaster-style guitars. Steel backplates may also be added to Stratocaster-style single coil pickups to reduce high frequency brittleness and fatten the tone at midrange frequencies. Telecaster bridge pickups with copper-coated steel backplates and conventional backplates for Stratocaster-style single coil pickups are manufactured, for example, by Lindy Fralin pickups of Richmond, Va.

Figure 15:
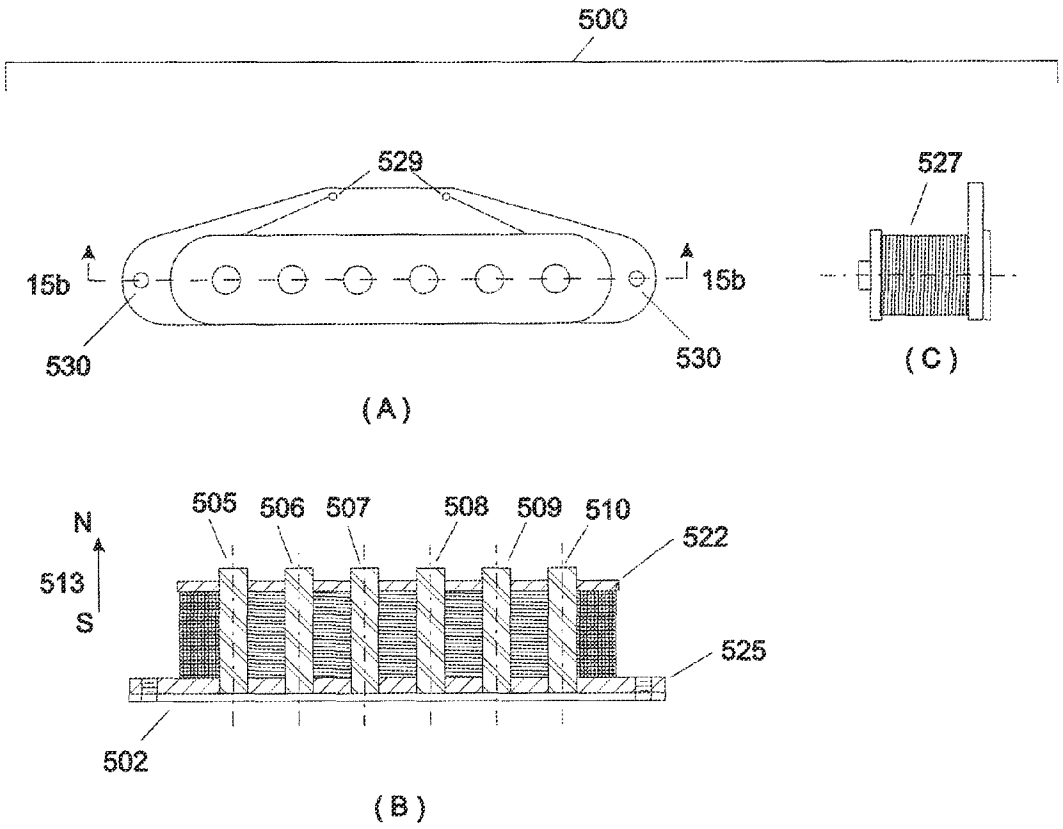
FIG. 15(A) is a top projection view of a Stratocaster-style single coil pickup with a ferromagnetic backplate.
FIG. 15(B) is a sectional front view of the single coil pickup and backplate taken along the line 15*b* in FIG. 15(A).
FIG. 15(C) is a side projection view of the single coil pickup and backplate of the single coil pickup and backplate.
Figure 16:
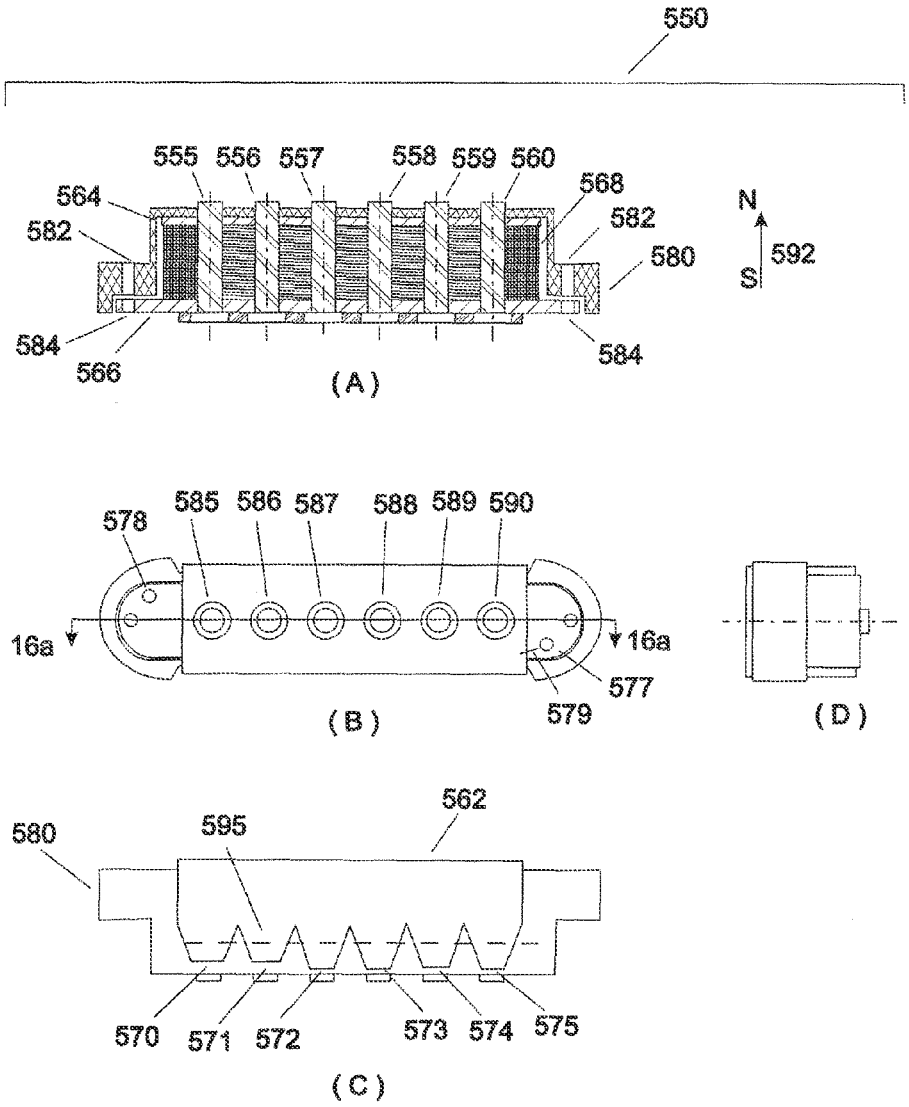
FIG. 16(A) is a front sectional view of a Jaguar-style single coil pickup taken along the line 16*a* in FIG. 16(B).
FIG. 16(B) is a bottom projection view of the Jaguar-style pickup.
FIG. 16(C) is a back projection view of the Jaguar-style pickup.
FIG. 16(D) is a side projection view of the Jaguar-style pickup.

U.S. Utility application Ser. No. 13/725,344 ('344), entitled "Musical Instrument Pickup with Hard Ferromagnetic Backplate" and filed by the inventor on Dec. 21, 2012, describes the use of hysteresis material backplates to modify the tone of pickups with self-magnetizing pole pieces. FIG. 15(A)-(C) is a sectioned orthographic projection drawing illustrating a pickup 500 that embodies the present invention. It is similar in basic design to the conventional single coil pickup 200 that is illustrated in FIG. 7(A)-(C) but includes a backplate 502 that is formed from low permeability material that comprises a granulated hysteresis or soft ferromagnetic material and an insulating binder. The self-magnetized pole pieces 505-510 are formed from Alnico 5 or other conventional hard material and are magnetized with the polarity indicated by the arrow 513. The pole pieces are pressed through holes in conventional upper and lower endplates 522, 525 that hold the pole pieces and the wire coil 527 in stable relative positions. The wire coil 527 is conventionally wound with approximately 8000 turns of No. 42 plain enamel wire and the ends of the coil are connected to conductive ferrules 529 in the bottom endplate 525. Threaded holes 530 in the endplate 529 facilitate mounting the pickup 500 in a musical instrument.

The backplate 502 influences the tone of the pickup 500 by interacting with a time-varying portion of the magnetic flux that is generated by the pole pieces 505-510. Backplates that are formed, at least in part, from granular ferromagnetic materials in an insulating binder have ferromagnetic properties that differ from loss properties of conventional soft ferromagnetic backplates. Specifically, the low permeability of the bound materials have a reduced effect on the resonance frequency of the pickup 500 and the relative magnitude of eddy current losses is reduced in comparison to the magnitude of the hysteresis losses. By varying the size, concentration and composition of the ferromagnetic granules in the backplate 502, it is possible to adjust its tonal properties over a significant range.

In alternative embodiments of the invention, the backplate 502 may have a composite structure with one or more components that are formed from a material that comprises a granular hysteresis or soft ferromagnetic material and an insulating binder. In addition to the bound ferromagnetic component, composite backplates may include soft ferromagnetic components and/or hard ferromagnetic components in various magnetization states. Composite backplate components may also be arranged in a different geometric configurations as detailed in U.S. Application No. 61/579,499 entitled "Magnetic Instrument Pickup with Hysteresis Plate" that was filed by the inventor on Dec. 22, 2011.

MFD-style pickups of the type described in U.S. Pat. No. 4,220,069 issued to Leo Fender on Sep. 2, 1980 and currently manufactured by the G&L Guitar Company of Fullerton, Calif., have soft ferromagnetic pole pieces with fields that are induced by a permanent magnet flux source and a soft ferromagnetic keeper that shapes the magnetic field distribution of the pickup. The keeper is typically formed from low carbon steel and attached to the bottom surface of a ceramic permanent magnet. Soft ferromagnetic keepers may also used to modify the field distribution of pickups with self-magnetized hard ferromagnetic pole pieces pole pieces as detailed in U.S. Pat. No. 3,236,930 issued to C. L. Fender on Feb. 22, 1966.

As defined in the present application, magnetic field modifiers are pickup components that modify the spatial distribution of the primary magnetic field that surrounds the pole pieces of a pickup. In different pickup designs, the primary magnetic field may be generated by self-magnetized pole pieces or by permanent magnets that induce fields in soft ferromagnetic pole pieces. According to this definition, the soft ferromagnetic keepers that are detailed in '069 and '930' are magnetic field modifiers.

FIG. 16(A)-(D) is a sectioned orthographic projection drawing of conventional Jaguar-style single coil pickup 550 with a set of six magnetized hard ferromagnetic pole pieces 555-560 and a steel field modifier 562 that transfers flux from the bottom of the pole pieces 555-560 to the upper ends of clawlike modifier extensions 570-575 on the front and back sides of the pickup. The pole pieces 555-560 are conventionally pressed into holes in an upper endplate 564 and a lower endplate 566 and surrounded by a wire coil 568. The ends of the wire coil 568 are terminated in conductive ferrules 577, 578 that are typically used to connect the pickup to the tone circuit of a guitar. In pickup 550, the field modifier is connected to the terminal 577 by a wire 579 that is typically soldered to the modifier 562 and terminal 577. When the terminal 577 is connected to electrical ground by an external circuit, the modifier 562 partially shields the pickup from electromagnetic interference.

The pickup 550 is surrounded by an insulating protective cover 580 that is typically made of low-cost plastic or similar material and clearance holes 582, 584 in the pickup cover and lower end plate allow the pickup 550 to be attached to the body of a guitar with screws. The upper ends of the pole pieces 555-560 extend through holes in the pickup cover 580 and holes 585-590 on the bottom of the modifier 562 surround the bottom ends of the pole pieces 555-560 but do not contact them. The pole pieces 570-575 are magnetized so that their upper surfaces are North magnetic poles as indicated by the direction arrow 592 and a magnetization is induced in the magnetic field modifier 562 so that the upper ends of the extensions 570-575 are South poles. When the pickup 550 is mounted in a guitar, the extensions 570-575 modify the magnetic field distribution in the strings and create a magnetic circuit that includes the strings of the instrument, the pole pieces 555-560, and field modifier 562. The tone of the pickup is shaped, in part, by ferromagnetic losses in the pole pieces and field shaper, the magnetization state of the pole pieces and the permeability of the field modifier.

In embodiments of the invention, the ferromagnetic losses and permeability of the field modifier 562 may be advantageously engineered by fabricating portions of the modifier from low permeability materials that comprise a hysteresis or soft ferromagnetic material and an insulating binder, attaching sheets of bound granular materials to the modifier 562, or by coating bound granular materials on one or more of the modifier surfaces. In some embodiments, for example, the portions of the extensions 570-575 that are above the dotted line 595 may be fabricated from a low permeability bound material and bonded to a high permeability body. In others, the holes 585-590 may be filled with a low permeability bound material or a sheet of bound material may inserted between the modifier 562 and the lower endplate 584.

The primary magnetic field of a single coil pickup may also be modified by attaching one or more permanent magnets to a surface of the pickup or a pickup cover. Field-modifying permanent magnets generate fields that are smaller than the primary pickup fields and are positioned with their poles closer to the upper, string-sensing surfaces of the pole pieces than to the bottom surfaces. U.S. application Ser. No. 12/940,517 ('517), entitled "Field Shaping Musical Instrument Pickup" and filed by the inventor on Nov. 5, 2010 describes pickups with field-modifying magnets that are mounted on an upper surface of a pickup or pickup cover. '517 is incorporated herein in by reference in its entirety.

Figure 17:
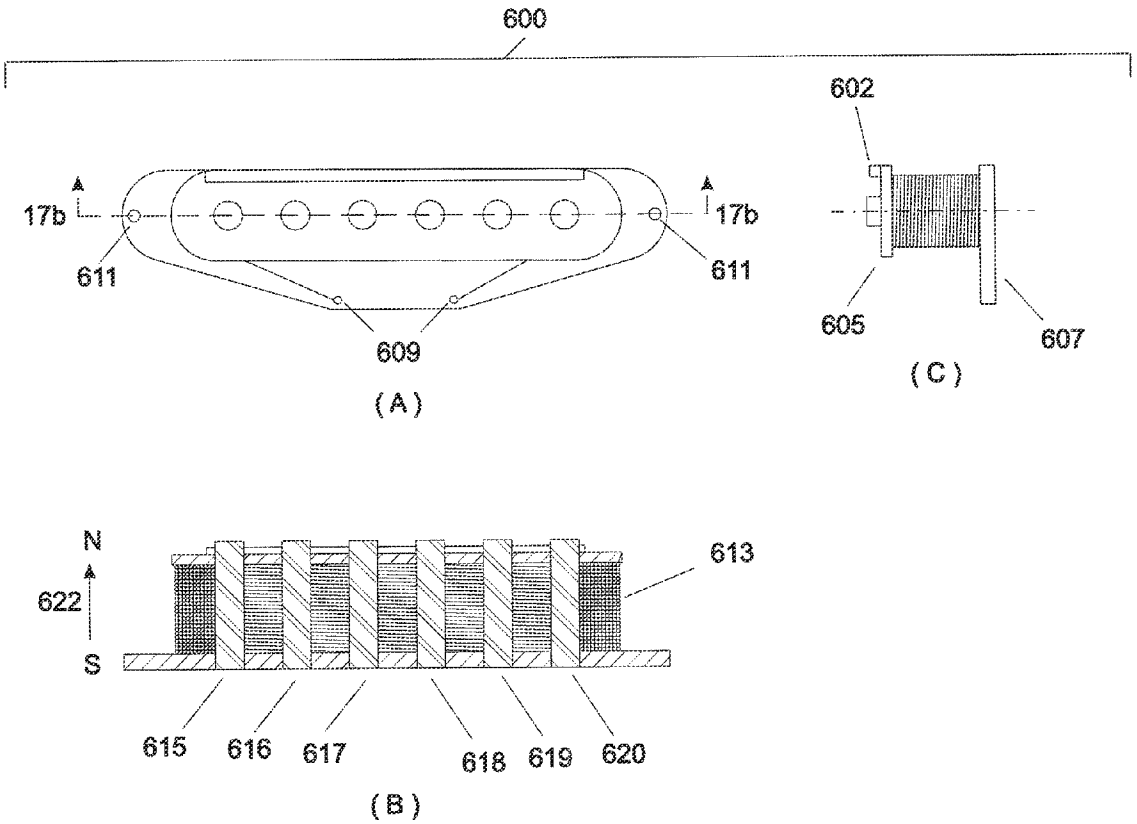
FIG. 17(A) is a top projection view of a Stratocaster-style single coil pickup with a permanent magnetic field modifier.
FIG. 17(B) is a front sectional view of the single coil pickup with a permanent magnetic field modifier taken along the line 17*b* in FIG. 17(A).
FIG. 17(C) is a side projection view of the single coil pickup with a permanent magnetic field modifier.

FIG. 17(A)-(C) is a sectional orthographic projection drawing of a single coil pickup 600 with a field-modifying permanent magnet strip 602 that is attached to upper endplate 605 according to the teachings of '517. The pickup 600 further comprises a wire coil 613 that is wound on self-magnetized pole pieces 615-620 that are formed from a conventional hard ferromagnetic pole material such as Alnico 5. The wire coil 613 is conventionally wound with #42 Formvar wire and the coils ends are soldered to conductive ferrules 609 that are typically used to connect the coil 613 to the guitar control circuit. The coil 613 and pole pieces 615-620 are held in stable relative positions by the upper endplate 605 and the lower endplate 607 which has conventional mounting holes 611.

The pole pieces 615-620 generate a primary magnetic field that is polarized in the direction of the arrow 622. The field-modifying magnet 602 is magnetized in a direction that is parallel or antiparallel to the direction of the arrow 622. It is typically formed from a flexible or bonded hard ferromagnetic material that comprises packed granules of a ferrite or rare earth material in a thermoplastic or thermosetting binder. A representative magnet 602 is approximately 0.060 thick in the magnetization direction and 0.125 wide and is formed from a standard-energy ferrite-based flexible magnet material of the type manufactured by the Flexmag Division of Arnold Magnetics of Marietta, Ohio.

In pickups embodying the present invention, the magnet 602 may be a permanent magnet that comprises granules of a hysteresis or soft ferromagnetic material in an insulating binder or it may have a composite structure that comprises a bound hysteresis or soft ferromagnetic component and a conventional ferrite or rare earth based permanent magnet. In a representative embodiment, the field modifier 602 has a composite structure with a conventional ferrite-based flexible magnet lower component and an upper component that is formed from 50 mesh iron granules in an acrylic art gel binder. The flexible magnet is approximately 0.030 thick× 0.125 wide×2.25" long. The bound iron material has the same length and width as the magnet and is approximately 0.015" thick. The bound material sheet is attached to the North pole of the flexible magnet using a conventional adhesive and composite assembly mounted on the upper end plate 605 of the pickup 600 with its magnetic field parallel to the primary field of the pickup.

Figure 18:
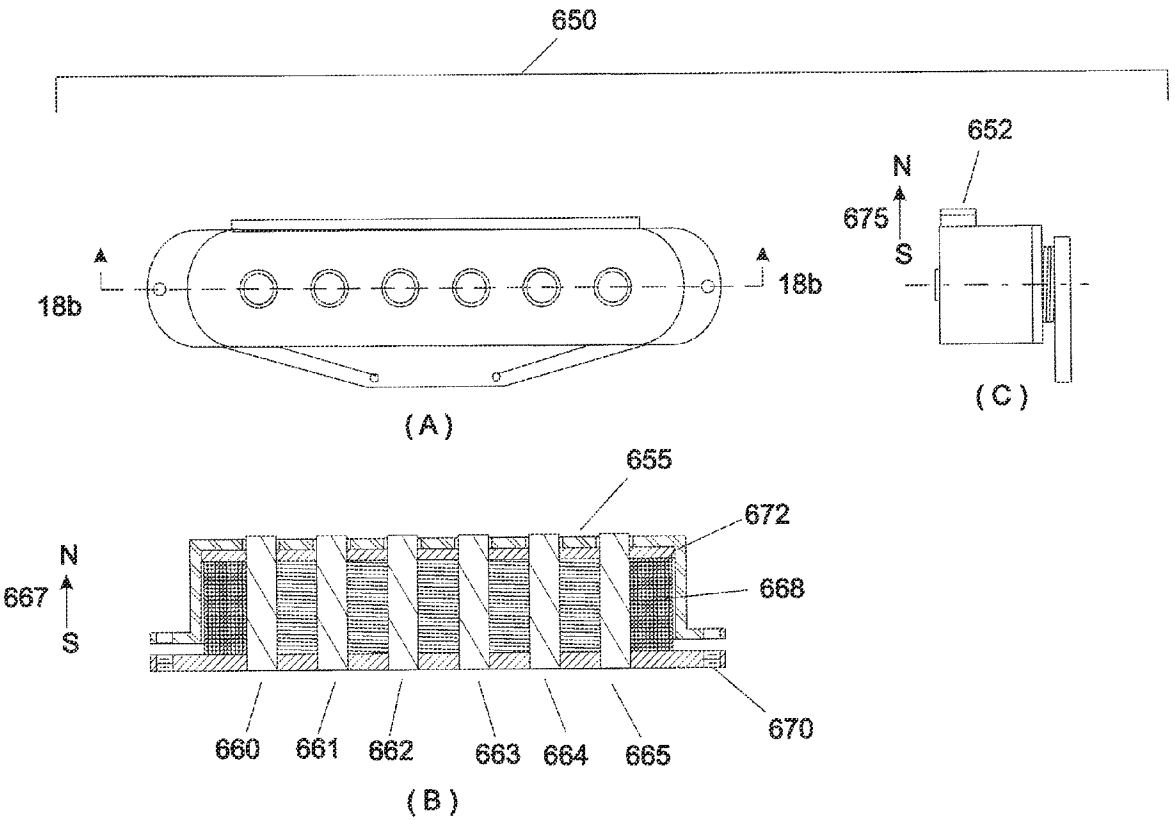
FIG. 18(A) is a top projection view of a covered Stratocaster-style single coil pickup with a composite permanent magnet field modifier mounted on the back of the pickup cover.
FIG. 18(B) is a front sectional view of the covered single coil pickup taken along the line 18*b* in FIG. 18(A).
FIG. 18(C) is a side projection view of the covered single coil pickup.

In further embodiments of the invention, one or more field-modifying magnets may generate fields that are approximately orthogonal in direction to the primary field. FIG. 18(A)-(C) illustrates a covered single coil pickup 650 with a field-modifying composite magnet 652 that is mounted on the side of the pickup cover 655. The pickup 650 has conventional self-magnetizing pole pieces 660-665 that are magnetized in the direction of the arrow 667, and further comprises a conventional wire coil 668, and endplates 670, 672. The composite field modifying magnet 652 comprises a 0.060" thick standard energy ferrite-based flexible magnet and a thin sheet of granulated iron in an acrylic binder. The components of the composite magnet 652 are bonded together and attached to the pickup cover 655 with a conventional adhesive so that the field generated by the modifier is polarized in the approximate direction of the arrow 675. In the illustrated embodiment, the permanent magnet is attached to the pickup cover, but in other embodiments, the position of the components may be reversed.

When the pickup 650 is mounted in a Stratocaster or other guitar, the pole pieces 660-665 generate a primary magnetic field in the space surrounding the pickup and in the strings. The composite magnet 652 affects the tone of the pickup 650 by modifying the distribution of the primary magnetic field and by interacting with magnetic field fluctuations that are generated by string vibrations. Changes in the primary field distribution alter the relative amplitude of the vibrational harmonics that are detected by the pickup while the interaction between components of the magnet 652 and the time varying field modifies the pickup output spectrum through hysteresis and eddy current loss mechanisms.

In other embodiments of the invention, magnetic pickups may have one or more field-modifying permanent magnets and at least one component that is formed from a low permeability material that comprises granules of a hysteresis material or soft ferromagnetic material and an insulating binder. Field-modifying magnets may have monolithic or composite structures and be mounted on a pickup endplate, cover or other component with their poles oriented in various directions. In embodiments with two or more field modifying magnets, different magnets may have different structures, comprise different materials, have different magnetic field strengths and be mounted to the pickup with their poles oriented in different directions. In further embodiments, field modifying magnets may be integrated into pickup covers, endplates, or other components.

Pickups embodying the invention may also comprise components that are fabricated from unmagnetized bound ferromagnetic materials. Time-varying magnetic fields typically pass through endplates, bobbins and pickup covers and may be modified by ferromagnetic losses in the portions of these components that are located near the strings.

Figure 19:
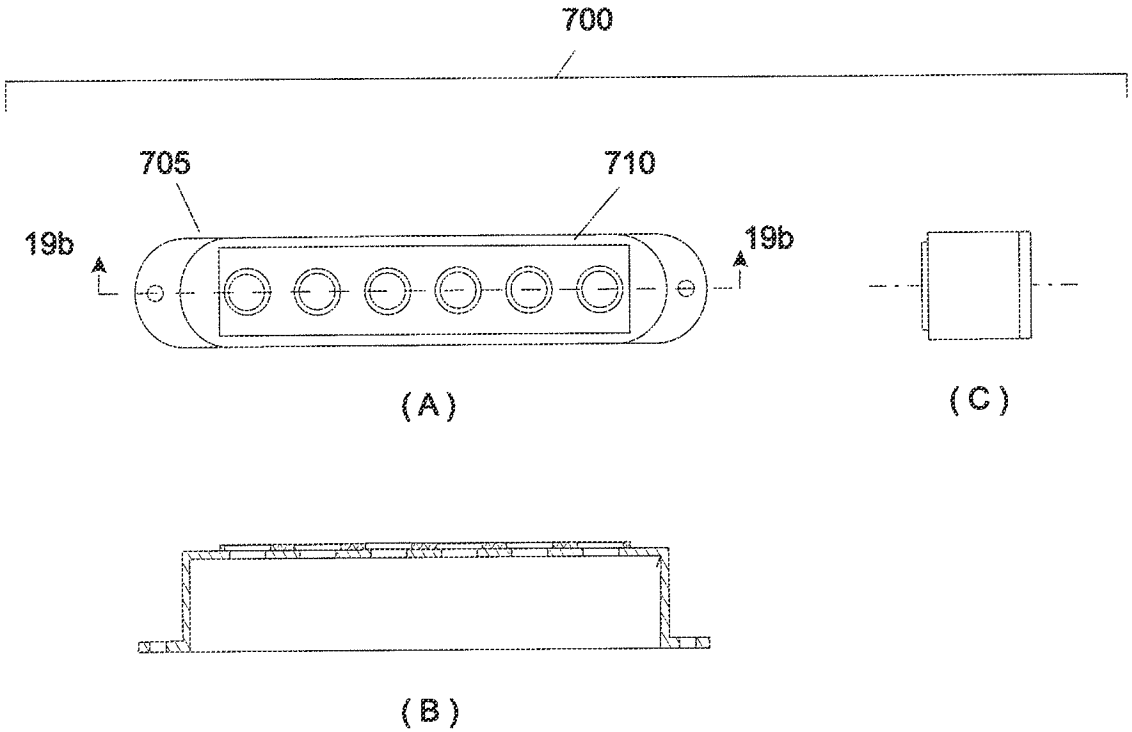
FIG. 19(A) is a top projection view of a pickup cover with a ferromagnetic loss element.
FIG. 19(B) is a sectional front view of the pickup cover with a ferromagnetic loss element taken along the line 19*b* in FIG. 19(A).
FIG. 19(C) is a side projection view of the pickup cover with a ferromagnetic loss element.

FIG. 19(A)-(C) is a sectioned orthographic projection drawing that illustrates a tone-modifying Stratocaster-style pickup cover 700 with features of the present invention. The cover 700 comprises a conventional plastic body 705 and a ferromagnetic loss element 710 that is attached to the upper surface of the body 705. The loss element 710 is formed from a low permeability material that comprises a granulated hysteresis or soft ferromagnetic material and an insulating binder and is attached to the body 705 with a conventional adhesive.

In a representative embodiment of the invention, the tone of the conventional pickup 200 is modified by placing the cover 700 over the pickup when it is mounted in a guitar. The body 705 of the exemplary cover 700 is the stock plastic pickup cover from a Stratocaster guitar and the loss element 710 is a 0.030 sheet of granulated Alnico 3 in a flexible polyurethane molding compound. The holes in the loss element 710 have diameters that are slightly larger than the holes in the pickup cover 705 and the length of the loss element is approximately 0.25 inches greater than the distance between the outmost edges of the pickup cover holes.

In other embodiments, the loss element 710 may be sandwiched between the upper endplate 222 of the pickup 200 and the stock pickup cover body 705 or it may be embedded in the pickup cover 705 or in one of the endplates 222, 225 of the pickup 200. Multiple loss elements may also be incorporated into a single pickup or pickup cover and individual loss elements may have composite structures that incorporate materials with different ferromagnetic properties. In further embodiments, pickup covers and upper endplates may be formed entirely from bound ferromagnetic materials or comprise patterned volumes that are formed from bound granules.

In further embodiments of the invention, nonmagnetic loss elements that are formed from materials that comprise a granulated hysteresis material or soft ferromagnetic material and an insulating binder may be incorporated into bobbins or other mounting components. For example, the bobbin 412 of the screw pole single coil pickup 400 may be partially or completely formed from a low permeability bound material. Alternatively, cavities in conventional plastic bobbins may be filled with bound materials.

Figure 20:
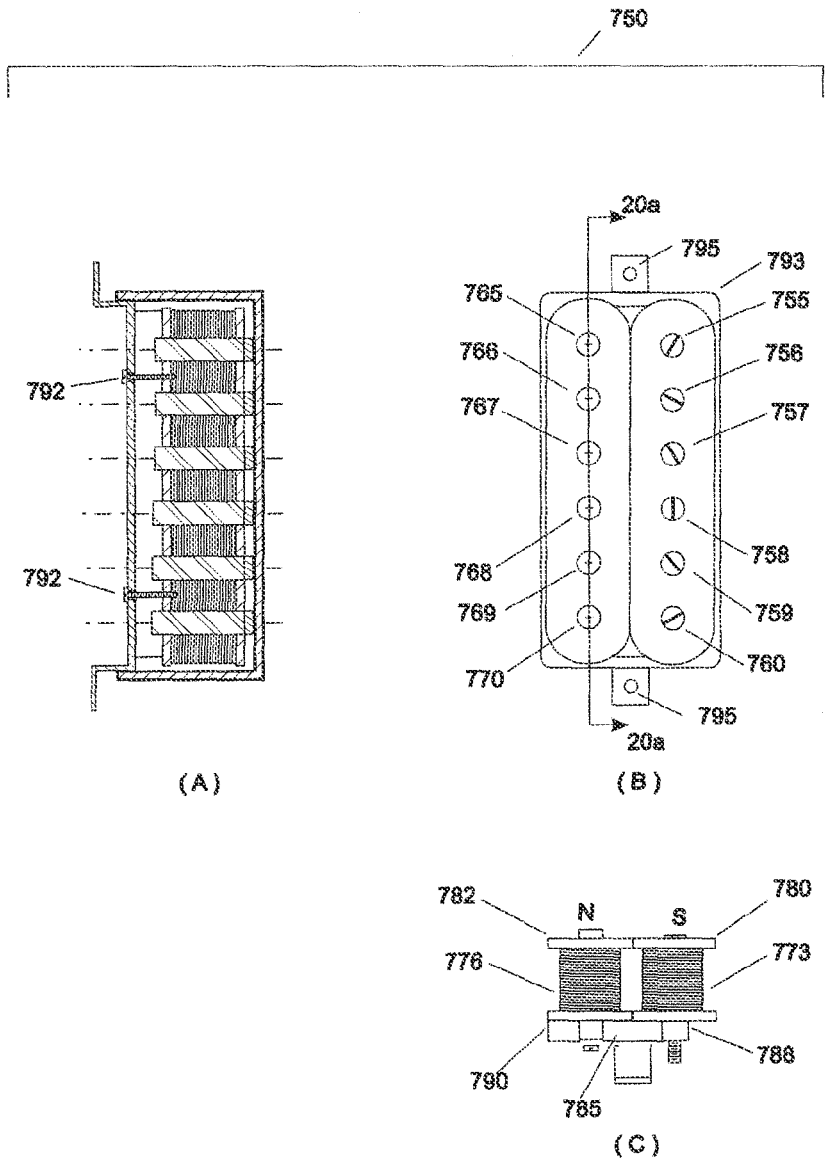
FIG. 20(A) is a sectional front view of a Gibson-style humbucker pickup with capped slug poles taken along the line 20*a* in FIG. 20(B).
FIG. 20(B) is a top projection view of the Gibson-style humbucker pickup.
FIG. 20(C) is a side projection view of the Gibson-style humbucker pickup.

FIG. 20(A)-(C) illustrates a Gibson-style humbucking pickup 750 that embodies features of the invention. The screw poles 755-760 in the pickup 750 are formed from a conventional high permeability material such as a low carbon steel. Each of the slug poles 765-770 comprises a high permeability cylindrical body component and a pole cap that is fabricated from a bound ferromagnetic material. In a representative example, the bodies of the poles 765-770 are conventional nickel-plated soft iron humbucker pole pieces and the caps are 0.020" thick discs of granulated iron in an acrylic medium binder. The caps are attached to the top of the conventional pole pieces with an adhesive that may, in some cases, allow the caps to be removed from the pickup and later repositioned. The composite slug poles 765-770 are supported by an insulating bobbin 782 that may be formed from a butyrate or other suitable plastic material and partially surrounded by a wire coil 776. The screw poles 755-760 are similarly supported by the insulating bobbin 780 and partially surrounded by the wire coil 773. The wire coils 773, 776 are wound in a similar fashion and, in a representative case, comprise 5250 turns of No. 42 plain enamel wire. In alternative designs, the wire size, number of turns and insulation material in the coils may vary.

A magnetic field is induced in the soft ferromagnetic pole pieces by a permanent magnet 785 so that the upper, string-sensing surfaces of the composite slug poles have a magnetic polarity that is opposite to that of the screw poles. In the pickup 750 the upper surfaces of the pole caps are North poles and the screw heads are South poles. The permanent magnet 785 is typically formed from a cast Alnico alloy or hard ferrite and is approximately 0.125" thick×0.50" wide×2.50" long. The slug poles 765-770 are directly side-coupled to the North pole of the magnet 785 and the screw poles 755-760 are coupled to the South pole by a soft ferromagnetic keeper bar 788. The bobbin 780 is partially supported by the magnet 785 and the keeper bar 788 and the bobbin 782 is partially supported by the magnet 785 and a support bar 790 that is typically formed from an insulating structural material. The bobbins, pole pieces, magnet, support bar and keeper bar are held in stable relative positions by screws 792 that pass through the metal base plate 793 and are threaded into the bobbins 780, 782. Threaded holes 795 in the baseplate allow the pickup 750 to be conventionally mounted in a guitar.

Figure 14:
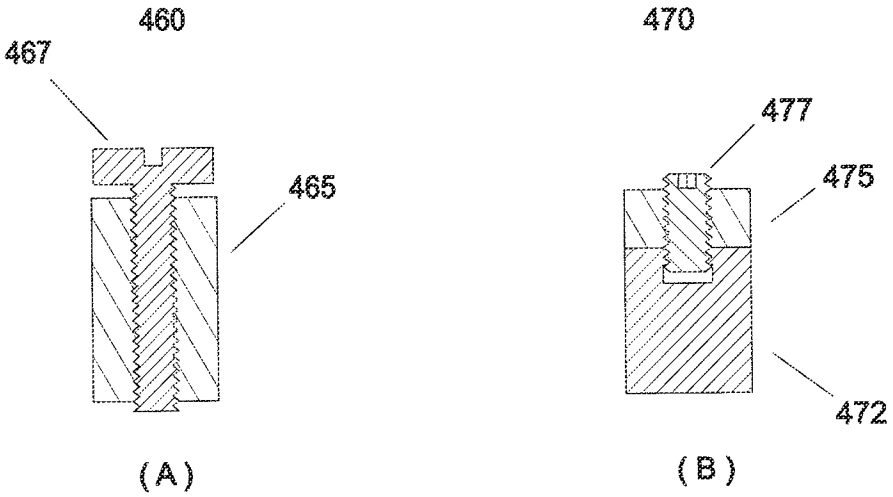
FIG. 14(A) is a sectional front view of a composite pole piece consisting of a threaded sleeve and screw.
FIG. 14(B) is a sectional front view of a pole piece with a cylindrical threaded composite body and a screw.

Other Gibson-style humbucking pickups that embody the invention may incorporate high permeability soft ferromagnetic components and bound ferromagnetic components in composite pole arrangements that include, but are not limited to the configurations illustrated in FIGS. 9 (A)-(D), 13(A)-(C) and FIG. 14 (A)-(B). In further embodiments, humbucking pickups may incorporate composite magnets, bobbins, passive loss elements, permanent magnet field shapers, support bars, keeper bars and/or pickup covers with at least one component that is formed from a low coercivity material that comprises granules of a hysteresis or soft ferromagnetic material and an insulating binder.

Humbucking pickups are often mechanically protected and partially isolated from electromagnetic noise by covers that are typically glued or soldered to the baseplate. Conventional covers have holes that allow the screw poles to be adjusted by a user but do not provide access to the slug poles. In certain embodiments of the invention, permanent magnet field modifiers or nonmagnetized loss elements may be attached to the outer surface of the pickup cover. In some cases, nonmagnetic loss elements may be advantageously attached to a pickup cover in positions that are directly above the slug poles.

Pickups that embody the present invention comprise at least one component that is positioned to interact with string-induced magnetic field variations and is formed, at least in part, from a low permeability material that comprises a granular hysteresis or soft ferromagnetic material in an insulating binder. Bound granular materials may be incorporated into a pickup during its initial manufacture, or in many cases, the tonal properties of an existing magnetic pickup can be improved by replacing one or more components with components that comprise bound materials or by adding a bound material component to the pickup.

In further embodiments, the invention is embodied in methods for modifying the tone of an existing pickup by retrofitting the pickup to include a bound material component. Many pickups have pole pieces with exposed upper surfaces that can be easily retrofitted by the addition of one or more pole caps. Bound materials may also be added to the permanent magnets that generate the primary field of a pickup. Pickups may also be retrofitted by adding pickup covers, loss elements, backplates, permanent magnet field modifiers, and non-magnetic field modifiers that incorporate bound materials to the pickup. Advantageously, tone modifying components such as pole caps, loss elements and field modifiers may have self-adhesive, peel-and-stick surfaces that enable a user to easily mount them on a pickup. In further embodiments, pole pieces, pole caps, permanent magnets, pickup covers, backplates, field modifiers and loss elements may be replaced by components that incorporate bound ferromagnetic materials components.

Those skilled in the art of pickup design and manufacture will realize that the invention may be embodied in large number of alternative magnetic pickup designs that incorporate at least one component that is fabricated from a low permeability material that comprises a granulated hysteresis material or soft ferromagnetic material. Pickups embodying the present invention may be passive or active and include the entire range of prior art pole piece, magnet and coil configurations. Pickups that may advantageously incorporate features of the present invention include, but are not limited to, P-90's, Gibson-style full-sized humbuckers, Filtertron and other Gretsch-style humbuckers, NY-, Johnny Smith- and Firebird-style mini-humbuckers, P-bass, Jazz, MusicMan (MM), soapbar and humbucking bass pickups, MFD Z-coil pickups, MFD wide single-coil pickups, and MFD humbucker pickups, lipstick tube pickups, noiseless single coil pickups and pickups with one or more blade pole pieces. Embodiments that are based on these pickup designs and others, are characterized by bound material components that interact with string-induced magnetic field variations and modify the tone of a pickup, at least in part, through ferromagnetic loss processes that scale with the strength of the string-induced field variations. Depending on the specific pickup design, bound materials may be attached to or incorporated into various pickup components that include, but are not limited to, pole pieces, pickup covers, endplates, bobbins, permanent magnets, keeper bars, backplates and passive magnetic field modifiers. They may also be incorporated in various permanent magnet field modifiers and nonmagnetic loss elements.

Those skilled in the art will further understand that the invention may be practiced with materials that incorporate a wide range of granulated ferromagnetic materials. Suitable materials include conventional pickup materials such as alloys of Alnico and low carbon steel in addition to ferromagnetic materials with physical properties that are poorly suited to pickup applications. Embodiments of the invention may also incorporate granulated ferromagnetic nanomaterials and engineered metal powders with ferromagnetic properties that are well-suited to magnetic pickup applications.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A magnetic pickup for detecting the vibration of ferromagnetic strings on a musical instrument, the pickup comprising:

at least one ferromagnetic pole piece with each pole piece having at least one string-sensing surface;

a magnetic source associated with each of the at least one pole pieces that generates at least a portion of a magnetic field at the at least one string-sensing surface of each pole piece;

a wire coil having its innermost windings defining an interior coil volume and a top and bottom of the volume defined by a top and bottom of the wire coil, the wire coil surrounding at least a portion of each pole piece;

a mounting structure that secures each of the pole pieces and the coil in a stable relative position and enables their attachment to the stringed musical instrument; and a component that at least partially determines a tone of the pickup through ferromagnetic loss mechanisms, the component being formed from a low permeability material that comprises an insulating binder and a granulated ferromagnetic material that is selected from a group consisting of hysteresis materials and soft ferromagnetic materials and the low permeability component having a portion that is outside of the interior coil volume.

2. The magnetic pickup of claim 1 wherein the granulated ferromagnetic material is a soft ferromagnetic material.

3. The magnetic pickup of claim 1 wherein the granulated ferromagnetic material is a hysteresis material.

4. The magnetic pickup of claim 1 wherein the low permeability material further comprises a granulated material that is not ferromagnetic.

5. The magnetic pickup of claim 1 wherein the granulated ferromagnetic material is a first ferromagnetic material and the low permeability material further comprises a second granulated ferromagnetic material with ferromagnetic properties that differ from the ferromagnetic material properties of the first ferromagnetic material.

6. The magnetic pickup of claim 1 wherein one or more of the at least one ferromagnetic pole pieces comprises a pole cap that is formed from the low permeability material.

7. The magnetic pickup of claim 1 further comprising a ferromagnetic back plate that further shapes the output spectrum of the pickup and is formed from a hard ferromagnetic material.

8. The magnetic pickup of claim 1 further comprising a ferromagnetic back plate that comprises the component that is formed from the low permeability material.

9. The magnetic pickup of claim 1 further comprising a magnetic field modifier.

10. The magnetic pickup of claim 9 wherein the magnetic field modifier comprises a permanent magnet.

11. The magnetic pickup of claim 9 wherein the magnetic field modifier comprises the component that is formed from the low permeability material.

12. A magnetic pickup for detecting the vibration of the ferromagnetic strings of a musical instrument, the pickup comprising:

at least one ferromagnetic pole piece with each pole piece having at least one string-sensing surface;

a magnetic source associated with each of the at least one pole pieces that generates at least a portion of a magnetic field at the at least one string-sensing surfaces of each of the pole pieces;

a wire coil that surrounds at least a portion of each pole piece;

a mounting structure that secures each of the at least one pole pieces and the coil in stable relative position and enables their attachment to the stringed musical instrument; and a composite ferromagnetic element that at least partially determines a tone of the pickup, the ferromagnetic element comprising a first component that is formed from a low permeability material comprising an insulating binder and a granulated ferromagnetic material that is selected from a group consisting of hysteresis materials and soft ferromagnetic materials and a second component that is formed from a ferromagnetic material with ferromagnetic properties that are different than the ferromagnetic properties of the low permeability material of the first component.

13. The magnetic pickup of claim 12 wherein the second component is formed from a hard ferromagnetic material that is selected from the group consisting of bonded and flexible hard ferromagnetic materials.

14. The magnetic pickup of claim 12 wherein the second component is formed from a high permeability soft ferromagnetic material.

15. The magnetic pickup of claim 12 wherein the composite ferromagnetic element is a composite pole cap.

16. The magnetic pickup of claim 12 further comprising an element that is selected from the group consisting of a pickup cover, a magnetic field modifier, and a ferromagnetic back plate.

17. The magnetic pickup of claim 16 wherein the element that is selected from the group consisting of pickup covers, magnetic field modifiers, and ferromagnetic back plates is the composite pickup element.

18. A method of changing the tone of a magnetic pickup for sensing the vibration of ferromagnetic strings in a musical instrument, the pickup comprising at least one ferromagnetic pole piece having at least one string-sensing surface such that the string-sensing surface is in proximal relationship to the strings when the pickup is mounted in the instrument, a magnetic source that generates a magnetic flux and transfers at least a portion of the magnetic flux to each of the ferromagnetic pole pieces, a wire coil that surrounds at least a portion of each pole piece, and a mounting structure that secures each of the pole pieces and the coil in stable relative position and enables the pickup to be attached to the stringed musical instrument, the method comprising:

retrofitting the pickup to include a tone changing component that is formed from a low permeability material that comprises an insulating binder and a granulated ferromagnetic material that is selected from a group consisting of hysteresis materials and soft ferromagnetic materials.

19. The method claim 18 wherein the pickup is retrofitted by adding and securing the tone changing component that comprises the low permeability material to the pickup.

20. The pickup of claim 18 wherein the pickup further comprises an element that at least partially modifies the pickup tone, the element being selected from a group consisting of a pole cap, a ferromagnetic loss element, a ferromagnetic backplate, a magnetized field modifier, an unmagnetized field modifier, a ferromagnetic loss element, and a pickup cover.

21. The pickup of claim 20 wherein the low permeability tone changing component is added and secured to the element that is selected from the group consisting of a pole cap, a ferromagnetic loss element, a ferromagnetic backplate, a magnetized field modifier, a non-magnetic field modifier, a ferromagnetic loss element, and a pickup cover.

22. The method of claim 18 wherein the tone of the pickup is changed by replacing a component of the pickup with the component that comprises the low permeability material.

23. The method of claim 22 wherein the pickup further comprises an element that is selected from a group consisting of a pole cap, a ferromagnetic loss element, a ferromagnetic backplate, a magnetized field modifier, a non-magnetic field modifier and a pickup cover and the component that is removed and replaced to change the tone is the element that is selected from the group.

24. The magnetic pickup of claim 1 wherein the magnetic source comprises the at least one pole piece.

25. The magnetic pickup of claim 9 wherein a self-generated magnetic field strength of the magnetic field modifier is approximately zero.

26. The magnetic pickup of claim 12 wherein the magnetic source comprises the at least one pole piece.

27. A magnetic pickup for detecting the vibration of ferromagnetic strings on a musical instrument, the pickup comprising:

at least one ferromagnetic pole piece with each pole piece having at least one string-sensing surface;

a magnetic source associated with each of the at least one pole pieces that generates at least a portion of a magnetic field at the at least one string-sensing surface of each pole piece;

a wire coil that surrounds at least a portion of each pole piece;

a mounting structure that secures each of the at least one pole pieces and the coil in a stable relative position and enables their attachment to the stringed musical instrument; and a component that at least partially determines a tone of the pickup through ferromagnetic loss mechanisms, the component being formed from a low permeability material that comprises an insulating binder, a first granulated material that is selected from a group consisting of hysteresis materials and soft ferromagnetic materials, and a second granulated ferromagnetic material with ferromagnetic properties that are different than the ferromagnetic properties of the first granulated ferromagnetic material.

28. The magnetic pickup of claim 27 wherein the magnetic source comprises the at least one pole piece.

29. The magnetic pickup of claim 27 wherein the first and second granulated ferromagnetic materials are hysteresis materials.

30. The magnetic pickup of claim 27 wherein the first and second granulated ferromagnetic materials are soft ferromagnetic materials.

31. A magnetic pickup for detecting the vibration of ferromagnetic strings on a musical instrument, the pickup comprising:

at least one ferromagnetic pole piece with each pole piece having at least one string-sensing surface;

a magnetic source associated with each of the at least one pole pieces that generates at least a portion of a magnetic field at the at least one string-sensing surface of each pole piece and a magnetic field distribution in the strings when the pickup is mounted in the musical instrument;

a wire coil that links a portion of a magnetic flux in each pole piece;

a mounting structure that secures each of the pole pieces and the coil in a stable relative position and enables their attachment to the stringed musical instrument; and a component that at least partially determines a tone of the pickup through ferromagnetic loss mechanisms, the component being formed from a low permeability material that comprises an insulating binder and a granulated ferromagnetic material that is selected from a group consisting of hysteresis materials and soft ferromagnetic materials;

wherein the contribution of the low permeability component to the magnetic field distribution generated by the magnetic source at the strings is less than or equal to zero.

32. The magnetic pickup of claim 31 wherein the low permeability component is a component of a bobbin.

33. the magnetic pickup of claim 31 wherein the granulated ferromagnetic material is a hysteresis material and the component is essentially unmagnetized.

34. The magnetic pickup of claim 31 wherein the low permeability component is a ferromagnetic loss element.

35. A magnetic pickup for detecting the vibration of ferromagnetic strings on a musical instrument, the pickup comprising:

at least one ferromagnetic pole piece with each pole piece having at least one string-sensing surface;

a magnetic source associated with each of the at least one pole pieces that generates at least a portion of a magnetic field at the at least one string-sensing surface of each pole piece;

a wire coil that links a portion of a magnetic flux in each pole piece and surrounds an interior coil volume;

a mounting structure that secures each of the pole pieces and the coil in a stable relative position and enables their attachment to the stringed musical instrument; and a component that is located within the internal coil volume and at least partially determines a tone of the pickup through ferromagnetic loss mechanisms, the component being formed from a low permeability material that comprises an insulating binder and a granulated ferromagnetic material that is selected from a group consisting of hysteresis materials and soft ferromagnetic materials, wherein the low permeability component fills 50% or less of the internal coil volume that is not occupied by the at least one pole piece.

36. The magnetic pickup of claim 35 wherein the low permeability component is a portion of a bobbin.

* * * * *

UNITED STATES PATENT AND TRADEMARK OFFICE

CERTIFICATE OF CORRECTION

PATENT NO. : 8,853,517 B1
APPLICATION NO. : 13/827644
DATED : October 7, 2014
INVENTOR(S) : George J. Dixon It is certified that error appears in the above-identified patent and that said Letters Patent is hereby corrected as shown below:

In the Claims

Claim 33, Col. 28, line 31, "the magnetic pickup of claim 31 wherein the granulated" should read --The magnetic pickup of claim 31 wherein the granulated--

Signed and Sealed this
Thirtieth Day of December, 2014

Michelle K. Lee

Michelle K. Lee
*Deputy Director of the United States Patent and Trademark Office*